US008823355B2

(12) United States Patent
Hachmann et al.

(10) Patent No.: US 8,823,355 B2
(45) Date of Patent: Sep. 2, 2014

(54) FEED DEVICE FOR THE AUTOMATIC SHIFTING OF OBJECTS AND METHOD FOR DETECTING A MOVEMENT OF A FEED UNIT IN A FEED DEVICE

(75) Inventors: Georg Hachmann, Berlin (DE); Dariusz Kostecki, Wassertruedingen (DE)

(73) Assignee: Inventory Systems GmbH, Berlin (DE)

( * ) Notice: Subject to any disclaimer, the term of this patent is extended or adjusted under 35 U.S.C. 154(b) by 571 days.

(21) Appl. No.: 13/202,315

(22) PCT Filed: Feb. 19, 2010

(86) PCT No.: PCT/EP2010/052157

§ 371 (c)(1), (2), (4) Date: Aug. 18, 2011

(87) PCT Pub. No.: WO2010/094778

PCT Pub. Date: Aug. 26, 2010

(65) Prior Publication Data

US 2011/0304316 A1 Dec. 15, 2011

(30) Foreign Application Priority Data

Feb. 19, 2009 (DE) ..... 10 2009 009 827
Nov. 16, 2009 (DE) ..... 10 2009 046 734

(51) Int. Cl.
*G01R 31/02* (2006.01)

(52) U.S. Cl.
USPC ..... 324/73.1; 324/76.11; 211/54.1

(58) Field of Classification Search
USPC ..... 324/76.11, 73.1; 211/54.1
See application file for complete search history.

(56) References Cited

U.S. PATENT DOCUMENTS

| | | | |
|---|---|---|---|
| 3,083,067 | A | 3/1963 | Vos et al. |
| 3,785,501 | A | 1/1974 | Canning |
| 4,241,237 | A | 12/1980 | Paraskevakos et al. |
| 4,246,710 | A | 1/1981 | Mixer |
| 4,260,063 | A | 4/1981 | Bennett et al. |

(Continued)

FOREIGN PATENT DOCUMENTS

| | | | |
|---|---|---|---|
| BE | 1008382 | A3 | 4/1996 |
| CH | 22 30 95 | A | 8/1942 |

(Continued)

OTHER PUBLICATIONS

European Patent Office Communication dated Jul. 3, 2011 as received in related application No. 05 849 382.6.

*Primary Examiner* — Vincent Q Nguyen
(74) *Attorney, Agent, or Firm* — Maschoff Brennan

(57) ABSTRACT

A feed device for the automatic shifting of objects is provided. The feed device includes a storage area or a holding element and a driven feed unit by means of which an object arranged on the storage area or at the holding element of the feed device can be shifted when the feed unit engages at the object, and wherein the feed device includes at least one electronic component which electronically detects a movement of the feed unit. The electronic component is configured such that the covering of a distance by the feed unit during movement of the feed unit is directly detected as an electric pulse and that the covering of respectively predefined distances of the feed unit generates a pulse sequence characteristic for the distances covered by the electronic component having different contact device at which in each case a pulse is generated which is characteristic for the respective contact device when the feed unit has covered a predefined distance.

19 Claims, 17 Drawing Sheets

(56) References Cited

U.S. PATENT DOCUMENTS

| | | | |
|---|---|---|---|
| 4,412,292 | A | 10/1983 | Sedam et al. |
| 4,474,300 | A | 10/1984 | Entis |
| 5,009,334 | A | 4/1991 | Bodkins |
| 5,317,859 | A | 6/1994 | Schneider et al. |
| 5,613,621 | A | 3/1997 | Gervasi |
| 5,671,362 | A | 9/1997 | Cowe et al. |
| 5,671,851 | A | 9/1997 | Johnson et al. |
| 5,711,432 | A | 1/1998 | Stein et al. |
| 5,992,652 | A | 11/1999 | Springs |
| 6,105,791 | A | 8/2000 | Chalson et al. |
| 6,158,598 | A | 12/2000 | Josefsson |
| 6,269,285 | B1 | 7/2001 | Mignault |
| 6,896,543 | B2 | 5/2005 | Fort et al. |
| 7,468,665 | B2 | 12/2008 | Grundy |
| 2005/0040123 | A1 | 2/2005 | Ali |
| 2005/0168345 | A1 | 8/2005 | Swafford |
| 2005/0269279 | A1 | 12/2005 | Hardy et al. |
| 2005/0279722 | A1 | 12/2005 | Ali |
| 2008/0309489 | A1 | 12/2008 | Hachmann et al. |

FOREIGN PATENT DOCUMENTS

| | | | |
|---|---|---|---|
| CH | 265058 | A | 11/1949 |
| DE | 22 32 549 | A1 | 2/1973 |
| DE | 22 32 594 | A1 | 1/1974 |
| DE | 28 22 920 | A1 | 12/1978 |
| DE | 32 05 620 | A1 | 9/1982 |
| DE | 31 16 145 | A1 | 11/1982 |
| DE | 33 17 994 | A1 | 11/1983 |
| DE | 84 26 651 | U1 | 2/1985 |
| DE | 84 34 554 | U1 | 2/1985 |
| DE | 34 01 671 | A1 | 7/1985 |
| DE | 36 08 695 | A1 | 9/1986 |
| DE | 28 22 920 | C2 | 5/1987 |
| DE | 86 32 494 | U1 | 5/1987 |
| DE | 36 28 609 | A1 | 2/1988 |
| DE | 36 41 425 | A1 | 6/1988 |
| DE | 88 11 988 | U1 | 12/1988 |
| DE | 36 41 425 | C2 | 11/1989 |
| DE | 44 34 420 | A1 | 3/1995 |
| DE | 295 13 747 | U1 | 12/1996 |
| DE | 195 35 045 | A1 | 3/1997 |
| DE | 298 11 796 | U1 | 8/1998 |
| DE | 197 45 813 | A1 | 4/1999 |
| DE | 198 08 475 | A1 | 9/1999 |
| DE | 100 20 847 | A1 | 10/2001 |
| DE | 696 26 968 | T2 | 1/2004 |
| DE | 20 2004 011 758 | U1 | 11/2004 |
| DE | 20 2004 019 164 | U1 | 3/2005 |
| DE | 10 2004 027 151 | A1 | 4/2005 |
| DE | 20 2004 018 632 | U1 | 5/2005 |
| DE | 20 2005 002 958 | U1 | 6/2005 |
| DE | 103 58 950 | A1 | 7/2005 |
| DE | 20 2004 005 743 | U1 | 8/2005 |
| DE | 20 2005 010 088 | U1 | 10/2005 |
| DE | 20 2005 013 979 | U1 | 12/2005 |
| EP | 0 048 479 | A1 | 3/1982 |
| EP | 0 806 749 | A1 | 11/1997 |
| EP | 0 808 119 | B1 | 3/2003 |
| EP | 1541064 | A1 | 6/2005 |
| EP | 1 579 789 | A1 | 9/2005 |
| EP | 1541064 | B1 | 2/2006 |
| FR | 2 489 792 | A1 | 3/1982 |
| FR | 2 581 304 | A1 | 11/1986 |
| GB | 2180527 | A | 4/1987 |
| GB | 2406611 | A | 4/2005 |
| JP | 59031202 | A | 2/1984 |
| JP | 1056014 | A | 3/1989 |
| JP | 2206407 | A | 8/1990 |
| JP | 3039107 | A | 2/1991 |
| JP | 3272708 | A | 12/1991 |
| JP | 4129506 | A | 4/1992 |
| JP | 5095827 | A | 4/1993 |
| JP | 5184442 | A | 7/1993 |
| JP | 5305021 | A | 11/1993 |
| JP | 7011714 | A | 1/1995 |
| JP | 7136025 | A | 5/1995 |
| JP | 7231839 | A | 9/1995 |
| JP | 7241228 | A | 9/1995 |
| JP | 7303550 | A | 11/1995 |
| JP | 7327795 | A | 12/1995 |
| JP | 8010113 | A | 1/1996 |
| JP | 8033541 | A | 2/1996 |
| JP | 8066247 | A | 3/1996 |
| JP | 8098751 | A | 4/1996 |
| JP | 8173281 | A | 7/1996 |
| JP | 8202274 | A | 8/1996 |
| JP | 8242986 | A | 9/1996 |
| JP | 9056539 | A | 3/1997 |
| JP | 9075185 | A | 3/1997 |
| JP | 9084669 | A | 3/1997 |
| JP | 9135753 | A | 5/1997 |
| JP | 9135755 | A | 5/1997 |
| JP | 9238793 | A | 9/1997 |
| JP | 9238794 | A | 9/1997 |
| JP | 9285369 | A | 11/1997 |
| JP | 10052339 | A | 2/1998 |
| JP | 10057202 | A | 3/1998 |
| JP | 10066634 | A | 3/1998 |
| JP | 10094463 | A | 4/1998 |
| JP | 10099169 | A | 4/1998 |
| JP | 10137064 | A | 5/1998 |
| JP | 10151054 | A | 6/1998 |
| JP | 10155611 | A | 6/1998 |
| JP | 10211066 | A | 8/1998 |
| JP | 10225346 | A | 8/1998 |
| JP | 10286151 | A | 10/1998 |
| JP | 10304954 | A | 11/1998 |
| JP | 10313955 | A | 12/1998 |
| JP | 11000245 | A | 1/1999 |
| JP | 11004738 | A | 1/1999 |
| JP | 11018889 | A | 1/1999 |
| JP | 11018892 | A | 1/1999 |
| JP | 11032879 | A | 2/1999 |
| JP | 11046941 | A | 2/1999 |
| JP | 11056546 | A | 3/1999 |
| JP | 11076012 | A | 3/1999 |
| JP | 11192140 | A | 7/1999 |
| JP | 11244106 | A | 9/1999 |
| JP | 2000041797 | A | 2/2000 |
| JP | 2000041806 | A | 2/2000 |
| JP | 2000070085 | A | 3/2000 |
| JP | 2000070087 | A | 3/2000 |
| JP | 2000083774 | A | 3/2000 |
| JP | 2000116475 | A | 4/2000 |
| JP | 2000152859 | A | 6/2000 |
| JP | 2000157382 | A | 6/2000 |
| JP | 2000175783 | A | 6/2000 |
| JP | 2000217675 | A | 8/2000 |
| JP | 2000225044 | A | 8/2000 |
| JP | 2000296025 | A | 10/2000 |
| JP | 2000296038 | A | 10/2000 |
| JP | 2000333799 | A | 12/2000 |
| JP | 2000350647 | A | 12/2000 |
| JP | 2000354528 | A | 12/2000 |
| JP | 2000354530 | A | 12/2000 |
| JP | 2001008800 | A | 1/2001 |
| JP | 2001037567 | A | 2/2001 |
| JP | 2001061617 | A | 3/2001 |
| JP | 2001061619 | A | 3/2001 |
| JP | 2001124018 | A | 5/2001 |
| JP | 2001128816 | A | 5/2001 |
| JP | 2001137088 | A | 5/2001 |
| JP | 2001292873 | A | 10/2001 |
| JP | 2001299516 | A | 10/2001 |
| JP | 2001299526 | A | 10/2001 |
| JP | 2001309836 | A | 11/2001 |
| JP | 2001314291 | A | 11/2001 |
| JP | 2001340184 | A | 12/2001 |
| JP | 2002065421 | A | 3/2002 |
| JP | 2002085213 | A | 3/2002 |
| JP | 2002095562 | A | 4/2002 |
| JP | 2002162905 | A | 6/2002 |

(56) References Cited

FOREIGN PATENT DOCUMENTS

| | | | |
|---|---|---|---|
| JP | 2002276630 | A | 9/2002 |
| JP | 2002291590 | A | 10/2002 |
| JP | 2002300943 | A | 10/2002 |
| JP | 2002330848 | A | 11/2002 |
| JP | 2002336097 | A | 11/2002 |
| JP | 2002369735 | A | 12/2002 |
| JP | 2003177671 | A | 6/2003 |
| JP | 2003180468 | A | 7/2003 |
| JP | 2003219938 | A | 8/2003 |
| JP | 2003259924 | A | 9/2003 |
| JP | 2003265282 | A | 9/2003 |
| JP | 2003284631 | A | 10/2003 |
| JP | 2003310402 | A | 11/2003 |
| JP | 2004057325 | A | 2/2004 |
| JP | 2004057407 | A | 2/2004 |
| JP | 2004057774 | A | 2/2004 |
| JP | 2004180918 | A | 7/2004 |
| JP | 2004261458 | A | 9/2004 |
| JP | 2004329402 | A | 11/2004 |
| JP | 2004331131 | A | 11/2004 |
| JP | 2005021421 | A | 1/2005 |
| JP | 2005040211 | A | 2/2005 |
| JP | 2005074173 | A | 3/2005 |
| JP | 2005087225 | A | 4/2005 |
| JP | 2005087593 | A | 4/2005 |
| JP | 2005103105 | A | 4/2005 |
| JP | 2005152389 | A | 6/2005 |
| JP | 2005192586 | A | 7/2005 |
| JP | 2005192767 | A | 7/2005 |
| JP | 2005211241 | A | 8/2005 |
| JP | 2005245954 | A | 9/2005 |
| JP | 2005245955 | A | 9/2005 |
| WO | 94/24906 | A2 | 11/1994 |
| WO | 00/61438 | A1 | 10/2000 |
| WO | 03/039301 | A1 | 5/2003 |
| WO | 2006/023954 | A2 | 3/2006 |
| WO | 2006/061009 | A1 | 6/2006 |

FEED DEVICE FOR THE AUTOMATIC SHIFTING OF OBJECTS AND METHOD FOR DETECTING A MOVEMENT OF A FEED UNIT IN A FEED DEVICE

CROSS-REFERENCE TO A RELATED APPLICATION

This application is a National Phase Patent Application of International Patent Application Number PCT/EP2010/052157, filed on Feb. 19, 2010, based on German Patent Application No. 10 2009 009 827.5 filed on Feb. 19, 2009 and on German Patent Application No. 10 2009 046 734.3 filed on Nov. 16, 2009, the contents of which are incorporated herein by reference.

BACKGROUND

The present invention relates to a feed device for the automatic shifting of objects and to a method for detecting a movement of a feed unit in a feed device.

Feed devices for the automatic shifting of objects, in particular goods or goods packages, on a storage area or a shelf insert are used above all in retail trade. For reasons of clarity, products or goods offered for sale here usually are arranged one behind the other. To prevent that a product sold or removed produces a gap, pusher or feed devices are used. The same mostly are arranged behind the last product of the row and are provided with a drive, so that after removal of a product the gap produced is closed by advancing the succeeding products.

To be able in this connection to simultaneously determine filling levels or stocks, EP 1 541 064 A1 describes a goods presentation device which permits an electronic shelf filling level measurement and a further processing of the data obtained. For this purpose, the goods presentation device includes a sensor unit, which by means of a capacitive resistance changing with the location or position of the pusher determines its distance or position with respect to a front stop. Statements as to the stocks preferably are made via the changes in capacity or the current capacitance value by means of a calculating unit which provides the data detected for further processing. A disadvantage of this device consists in that a direct determination of stock removals is not provided for. The distances or positions of the pusher always are linked to a complex conversion of the capacitance values issued into adjustment positions.

A determination of the removal frequency upon removal of a plurality of products one after the other is not provided for either. Such determination or evaluation, respectively, of the signals detected is desirable, however, with regard to a control of the removal operation or for protection against theft. For example, WO 2006/061009 A1 discloses a fixture for at least one object, which includes a means for the automatic determination of the removal frequency of at least one object, preferably however of a plurality of objects from and/or out of the fixture. Due to the fact that it can thus be determined whether and how often an object is removed, not only the sale of goods, but also an unauthorized removal can be detected in a more detailed manner. For this purpose it is checked whether the removal frequency exceeds a predetermined threshold.

SUMMARY

Therefore, the problem underlying the invention is to improve a feed device as mentioned above.

A feed device for the automatic shifting of objects, in particular goods or goods packages, comprises a storage area or a holding element and a driven feed unit. By means of the feed unit, an object arranged on the storage area or at the holding element can be shifted when the feed unit engages the object. Furthermore, an electronic component of the feed device electronically detects a movement of the feed unit. In accordance with an exemplary embodiment of the invention, the electronic component is configured such that, during a movement of the feed unit, the covering of a distance by the feed unit is directly detected as an electric pulse and that the covering of respective predefined distances of the feed unit generates a sequence of pulses characteristic for the covered distances by the electronic component having different contact means at which in each case a pulse is generated which is characteristic for the respective contact means when the feed unit has covered a predefined distance.

In this respect, there is hence in particular provided an electronic component which is configured to detect the covering of a respective predefined distance by the feed unit during the movement of the feed unit. This detection of the covering of respective individual, predefined distances may then also be effected by evaluating a (single) pulse generated or a plurality of pulses generated.

Such feed units regularly include a simple tension spring, which is fixed at one point of the feed device and is tensioned when the storage area or the holding element is occupied with at least one object, so that the feed unit under spring tension engages a rear object of the row, in other words acts on the same. The undesired movement of the object or of the objects as a result of these forces applied usually is avoided by at least one stop which is located on the side of the front object of the row facing away from the feed unit. Only by specifically removing an object, the feed unit is driven in the direction of the gap produced and thus is moved. Beside such feed units moving along exactly one axis, feed devices are, however, also conceivable, which permit a for example guided movement of the feed device in several directions. By means of the solution in accordance with the invention, a direction of movement of the feed unit then can also be determined via a pulse sequence relevant for the direction of movement.

By respectively generating pulses (which are identical, i.e. have the same amplitudes) after predetermined or predefined distances of varying lengths via an electronic component of the feed device, a direct correlation of the distance covered can possibly also be achieved, as described, with the direction of movement, but also with the speed of the feed unit. For example in dependence on the frequency of the pulses generated or their (temporal) order, such conclusions are easily possible. Such provision of contact means, being arranged one behind the other along the electronic component or successively one after the other along an adjustment direction of the feed unit and respectively generating one identical pulse, but being arranged in varying distances to each other, may be effected in addition to a design of a feed device according to the invention.

According to an exemplary embodiment of the invention, contact means being different from each other are provided for generating distinct pulses which may be distinguished from each other, so that a pulse is generated when the feed unit has covered a predefined distance, wherein the pulse generated is characteristic for a respective contact means or a group of contact means.

Preferably, the electronic component includes contact means which are arranged at the distance of the predefined path and past which the feed unit is guided such that after the covering of the distance by the feed unit an electric pulse is generated on a contact means. These can be individual light barriers, individual magnetic detectors or electric contacts, which directly induce the generation of a pulse when the moving feed unit is guided past the same.

In principle, it is not decisive whether in the case of a plurality of predefined paths the same each have the same length. Preferably, however, the contact means are uniformly distributed along a measurement path to be covered maximally. In this connection, the arrangement of the contact means in the form of a raster on the electronic component is regarded as advantageous.

From the solutions mentioned above, the configuration of the contact means as electric contacts in the form of conductors or of conductor sections is preferred for cost reasons. Especially in this connection, the electronic component then can also be configured as a printed circuit board.

According to the invention, the electronic component of the feed device is configured such that the covering of predefined distances by the feed unit each generates a pulse sequence characteristic of the distances covered. Such characteristic pulse sequence can be obtained for example in that pulses of different amplitude are generated when predefined distances are covered. Following the above-described configurations of the feed devices with a printed circuit board as electronic component, the conductors arranged thereon can at least partly differ from each other. This can mean for example that a certain number of different types of conductors alternately is arranged on the printed circuit board. In cooperation with the feed unit guided past the same, each type of conductor each results in a pulse characteristic for this type of conductor, e.g. with a certain pulse amplitude.

In this way, a characteristic pulse sequence can be generated during a movement of the feed unit along the storage area or the holding element and can be detected by an electronic evaluation unit. Such characteristic pulse sequence can be utilized, for example, to detect in what direction the feed unit is or has been shifted on the storage area or along the holding element.

This is of particular advantage in order to determine if goods were removed from the storage area or from the holding element and if e.g. a theft surveillance has to be activated. Such theft surveillance may be in particular carried out on the basis of a frequency of pulses measured during movement of the feed unit (frequency of removal). Thus, on the basis of a high, atypical frequency of removal may be concluded that many goods are removed at the same time like it is usual during thefts. However, a theft surveillance is hence only expedient if goods are removed from the storage area or the holding element, the feed unit thereby moving in a specific adjustment direction. This adjustment direction, at which a theft surveillance should be active, usually is the direction towards a front of the feed device being visible to a customer. If in contrast thereto new goods are arranged on the storage area or at the holding element or goods are put back or placed back, the feed unit moves in the opposite direction and a theft surveillance is not necessary. It is or stays deactivated to not cause a false alarm.

Accordingly, movement situations of the feed unit being different from each other, can be determined due to the design of the feed device in accordance with the invention. Thus, a removal of goods may be distinguished from a refill of the feed device (by staff or due to a return of goods) with respect to the direction of movement of the feed device on the basis of a characteristic pulse measured or on the basis of a characteristic frequency of pulses. A theft surveillance for the feed device, which in particular determines a theft on the basis of a frequency of removals exceeding a threshold value, may hence improved and designed in a more reliable manner. Even a rapid (re)filling with goods or a rapid return of goods do not cause false alarms since the direction of movement of the feed unit can be identified and the theft surveillance is activated and deactivated depending on the direction of movement identified.

Alternatively or additionally, the different contact means may be respectively associated to one of several electric circuits. The individual electric circuits may be monitored by an evaluation unit so that the pulses respectively generated via one of the individual contact means may be precisely associated to a specific contact means. By doing so, pulses being distinguishable from one another may be interpreted by an evaluation unit and a direction of movement of the feed unit within the feed device may be identified on the basis of the resulting frequency of distinguishable (and optionally differing) pulses, both in a exceptionally simple manner.

Therein, several groups of contact means may also be defined, each group of contact means being associated with one of the several electric circuits and the contact means of the different groups being arranged alternately along the electronic component.

In the style of the above example, there can be defined three groups A, B and C of contact means, which are respectively assigned to one electric circuit. The contact means of the different groups are arranged in an alternating manner along the electronic component or along the adjustment path of the feed unit, respectively, so that a contact means of group B is always arranged between a contact means of group A and a contact means of group C. Already due to the evaluation of two consecutive pulses may hence be determined in which direction the feed unit moved or is currently moving. If e.g. a pulse of a contact means of group A is followed by a pulse of a contact means of group B the feed unit was moved in a first adjustment direction, whereas due to two consecutive pulses of contact means of groups A and C a movement in a second (opposite) adjustment direction may be identified.

As a matter of course, it is possible that the different contact means of the electronic component are not only respectively assigned to various electric circuits, but also respectively generate pulse with different amplitudes. An evaluation unit coupled to the electronic component or its contact means could thus not only evaluate the electric circuits of the individual contact means or of the groups of contact means, wherein the electric circuits are separated from each other, but could also evaluate the amplitudes of the pulses in order to particularly determine where the feed unit is within the feed device and/or in which adjustment direction the feed unit moved or is currently moving.

To on the one hand facilitate a modular structure of the feed device and on the other hand provide a maximum of space available for the objects above or on the storage area, it is regarded as advantageous that the electronic component for detecting the movement of the feed unit is arranged on the bottom surface of the feed device opposite the storage area.

Accordingly, to facilitate assembly it is preferred that the feed device is configured such that the electronic component is held by at least two guide rails, by means of which the electronic component can be introduced into or along the feed device relative to the storage area during assembly of the feed device.

For a more accurate detection or determination of the distance covered by the moving feed unit, a contact element can be arranged at the feed unit, which, after covering the respective distance, is in operative contact with the electronic component and causes the generation of an electric pulse. With regard to the embodiments described above, variants of the solution of the invention are distinguished above all, which generate a pulse not due to an interruption or variation of an existing electrical, magnetic or optical signal.

In this way, a contact element preferably is formed such that a contact region thereof contacts the conductors of the electronic component during the movement of the feed unit, the conductors being arranged at intervals of the predefined distances. An exemplary embodiment thus could also be realized via so-called sliding contacts.

Due to the fact that the contact element preferably can be plugged onto a section of the feed unit provided for this purpose, the assembly of the feed device of prefabricated individual components is further improved.

In one exemplary embodiment, the contact element is designed windable (so that it may be wound) and is mounted such that it is wound or unwound during a movement of the feed unit.

Such a contact element thereby may be also formed as a resetting element driving the feed unit, i.e. automatically causing movement of the feed unit upon a change in the filling level. Therefore, the contact element is preferably designed in the form of a strip-like tension spring to be wound and unwound which, depending on the position of the feed unit, respectively interacts by means of its length extending along the adjustment path of the feed unit with at least one of the contact means or several contact means (one after the other) in order to generate a (characteristic) pulse or a (characteristic) sequence of pulses. The (portion's) length of such a contact element, extending along the adjustment path or along the storage area or the holding element, respectively, varies due to the position of the feed unit. So, the effective length is for example increased by pulling out the tension spring during a refill with goods, whereas it is shortened upon a removal of goods and the movement of the feed unit towards a front stop automatically occurring therewith. In this way, a (new) contact means gets for example in operative contact with the tension spring during a refill of the feed device and the covering of at least one predefined distance by the feed unit occurring therewith, thereby generating a pulse which can be measured and evaluated.

In addition to the variant of the feed device of the invention as described above, in which a pulse characteristic for the covering of a predefined distance or a pulse sequence characteristic for the covering of a predefined distance or a plurality of predefined distances is generated, it can also be provided that the contact element in operative contact with the electronic component respectively defines a total electric resistance which varies for generating the characteristic pulse and/or the characteristic pulse sequence. Several different total resistances are obtained here e.g. in dependence on the contact means of the electronic component, via which the contact element is in operative contact with the electronic component. In a preferred embodiment, this means that a resistance inherent to the contact element is constant, but individual or all contact means on the electronic component, for example conductors of a printed circuit board, each have a different resistance.

When the contact element thus contacts a contact means of a first type with a first resistance, the contact element and this contact means define a first total resistance. This first total resistance differs from a second total resistance, which is defined via the contact element and a contact means of a second type with a second resistance (different from the first resistance). Via the different total resistances obtained during a movement of the feed unit, a characteristic pulse, e.g. with a certain amplitude, and/or a characteristic pulse sequence thus can each be detected in a relatively simple way.

Alternatively, it is provided in one exemplary embodiment that the contact element in operative contact with the electronic component respectively closes one electric circuit which is defined for the generation of a characteristic pulse and/or a characteristic sequence of pulses by the contact means.

Thus, a contact means may be formed by an interrupted conductor at the electronic component so that two ends of this conductor are separated from each other via a gap. The contact element provided at the feed unit connects these two ends of the conductor when it is in operative contact with the electronic component, and thus (electrically) bridges the gap between the two ends. By permanently energizing the conductor, this bridging of the ends of the conductor being separated from each other generates an electric pulse which may be measured and may be evaluated by an evaluation unit. For the evaluation it is thereby of course unimportant if solely a short pulse is generated when the feed unit passes over the conductor or if a respective electric circuit is permanently closed due to a stop of the feed unit in a position in which the contact element connects both ends of the conductor to each other.

Preferably, several contact means are arranged along the electronic component one after the other and are respectively assigned to one of several electric circuits. By doing so, a plurality of (at least two) different electric circuits can be successively closed by operative contact with the contact element during a movement of the feed unit, when the feed unit moves along the electronic component. By providing at least three electric circuits, which are separated from each other and may be evaluated separately and to which several contact means are assigned in groups, a direction of movement or direction of adjustment—as already outlined above—can identified therewith in a simple manner.

Just as the feed device preferably can be constructed of individual components, the feed device of one embodiment is formed as a built-in module, so that a plurality of feed devices can be used within one shelf system.

Such shelf system can for example be characterized by a plurality of feed devices arranged one beside the other on mounting rails, so that the feed device preferably forms through holes through each of which a mounting rail of the shelf system is guided. Furthermore, it is regarded as advantageous when the feed device comprises an evaluation unit or is connected with an evaluation unit which evaluates the pulses generated. Thus, such evaluation unit can be provided at the feed device, e.g. be accommodated inside the feed unit, or be connected with the same only by wire or wirelessly.

Independent of the place of accommodation of the evaluation unit, the same preferably is provided for example to evaluate a given number of detected pulses as a length of an object present on the storage area or at the holding element. For example, the feed device is initialized via the evaluation unit before being occupied with an object, i.e. a product or a merchandise or goods package. During initialization, the product depth is determined, so that the evaluation unit can convert the number of pulses into a number of product units. As a result, a number of detected pulses can be evaluated as a number of products/objects removed from the storage area or from the holding element.

With regard to the theft detection explained above or the determination of an atypical, i.e. possibly wrong, conspicuous or critical removal operation, the evaluation unit preferably is configured such that by means of the same the frequency with which objects were removed from the storage area or from the holding element can be determined and/or evaluated. In the case of a preferably central assessment of stocks or a central detection of removal operations, the evaluation unit alternatively or additionally can be configured to forward the data detected to a calculating unit.

Furthermore, by detecting the movement of the feed unit in accordance with the invention, an evaluation unit of the feed device or a calculating unit connected with the same can effectively be coupled with an automatic display unit. Such display unit for example is understood to be a control monitor, a control lamp or an advertising screen.

At a detected pulse frequency or characteristic pulse sequence, which indicates a possible theft of goods or goods packages present on the storage area or at the holding element of the feed device, a control monitor or control lamp can thus be actuated, which issues a visual and/or audible warning. This can be a control lamp or a control monitor mounted locally on the feed device or on a shelf system including the feed device. Alternatively or in addition, such control lamp or such control monitor can be arranged for example in a separate control room.

In the case of an alternatively or additionally provided display unit or an indicating element in the form of an advertising screen or an advertising display, it is possible to couple a detected movement of the feed unit with the presentation of an advertising message or a sales information. For example, on a front of the feed device visible for a buyer an advertising display is mounted, which during the detected movement of the feed unit and a removal of goods or goods packages inferred therefrom is playing back one of a plurality of possible advertising messages or a sales information.

A connection of an evaluation unit to the different contact means is preferably provided via a multi-conductor cable. If for example three groups of different contact means are provided for at the electronic component, which are respectively assigned in groups to one (of three) electric circuits, a cable having four conductors can be used for the connection to the evaluation unit. Whereas one of the conductors of the cable constitutes the feeder, each of the further three conductors respectively connects the evaluation unit to one of the groups of contact means so that each closure of an electric circuit of one group at one of the contact means can be detected by the evaluation unit at an input provided therefore. In a modification of the feed device according to the invention, the evaluation unit is configured and adapted to store a (measurement) value for a last pulse measured or detected. Additionally, several values for a last sequence of pulse measured may be stored.

By arranging several different contact means in an alternating manner along the electronic component, which contact means, e.g. due to their association with different resistors and/or different electric circuits, generate pulses being individually or in groups distinguishable from each other when the feed unit is moved, it hence can be already determined in which direction the feed unit is currently moving on the basis of a last-stored pulse value (or several last-stored pulse values) and of a single new pulse detected.

A feed device according to the invention having a holding element may in particular also be equipped with shelf hook, in or at which the objects to be moved by the feed unit or pusher are hooked.

A further aspect of the present invention is a method for detecting a movement of a feed unit in a feed device which is configured and provided for the automatic shifting of objects by means of the feed, unit the objects being arranged on a storage area of the feed device or at a holding element of the feed device. On the lines of a feed device according to the invention, it is here provided for that, for detecting the movement of the feed unit, at least one characteristic pulse is evaluated, which is respectively generated by the feed unit interacting with one of several different contact means of a electronic component after the feed unit has covered a predefined distance.

By respectively generating and evaluating one pulse, which is characteristic for a predefined distance and thus is different with respect to other pulses being generated for a subsequent or previous predefined distance, it is not only easy to determine that the feed unit has moved, but also the direction of movement of the feed unit may be identified. Thus, a characteristic sequence of pulses is generated by several pulses being distinguishable from each other if the feed unit has covered several predefined distances along its adjustment path. On the basis of a characteristic sequence of pulse, which is different for each direction of movement of the feed unit, it hence can be determined in which direction a movement or adjustment of the feed unit (currently) takes place or took place.

The embodiments of the feed device previously and subsequently described as being advantageous do hence also apply for advantageous embodiments of the method and vice versa.

BRIEF DESCRIPTION OF THE DRAWINGS

Further features and advantages of the invention will become apparent from the following description of embodiments with respect to the Figures.

DETAILED DESCRIPTION

Figure 1:
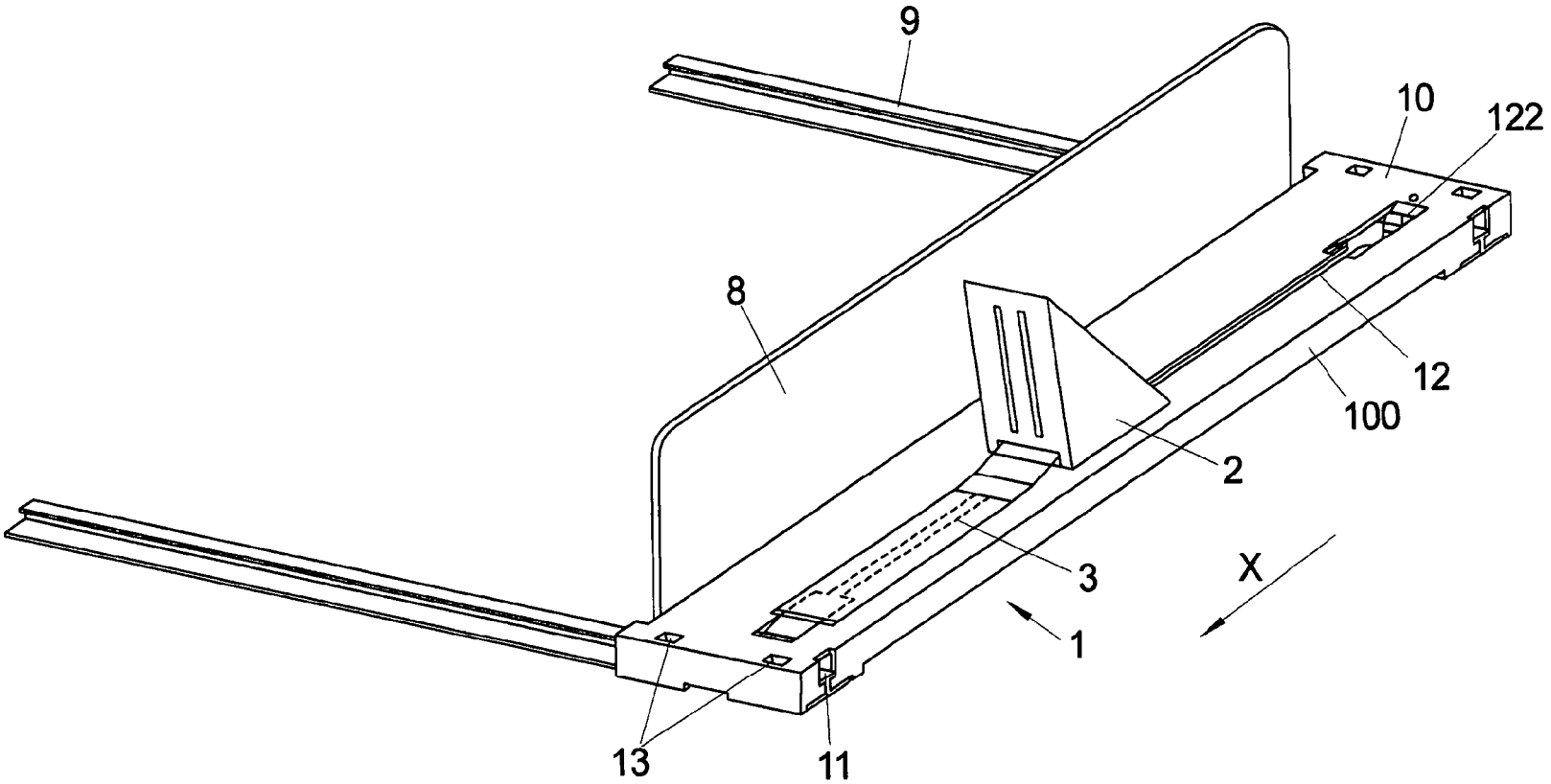
FIG. 1 shows a perspective front view of an embodiment of the feed device.

FIG. 1 shows an embodiment of an elongated feed device 1 which includes a planar, substantially rectangular storage area 10 and a feed unit 2 movably mounted thereon. In addition, the bottom surface of the feed device 1 is provided with a circumferential rim 100 extending vertically from the storage area 10.

A typical field of application of such feed device 1 is its use as a product pusher in shelf systems for the retail trade, in which goods or goods packages are arranged one behind the other on the storage area 10 of the feed unit 2. The feed unit 2 then usually is located behind the last product of a row and is not or hardly visible for the consumer. A tension spring 3 acting in the direction of the products, i.e. in the direction X of a front side of the feed device 1, which is fixed in the vicinity of the front side of the feed device 1 and can be wound up inside the feed unit 2, ensures that so-called gripping gaps are filled up during removal of a product or a merchandise or goods package, respectively.

The feed unit 2 furthermore is guided in a guideway 12 extending parallel to the longer lateral edges of the storage area 10. For this purpose, the guideway 12 is configured as a narrow aperture into which the feed unit 2 is introduced with a guide portion 21. At its ends, the guideway 12 is broadened and includes an insertion hole 122, in order to ensure insertion of a portion of the feed unit 2 molded below the storage area 12 into the guideway 12 during assembly of the feed device 1. Due to the symmetric design, an inexpensive manufacture e.g. of plastic material is possible.

During a movement of the feed unit 2 along the guideway 12, a predetermined distance each covered by the feed unit 2 will generate a pulse in accordance with the invention, so that e.g. via the number of pulses the total distance covered can be determined. Alternatively or in addition, the speed of the feed unit 2 and hence the removal frequency of objects from the storage area 10 can be determined via the frequency of the pulses generated.

Furthermore, the feed device 1 includes plug-in openings 13 for possible product stops in the vicinity of its front and rear sides, which in dependence on the desired functionality limit the shifting or moving of the goods and for example additionally integrate indicating elements such as a display.

Moreover, the illustrated feed device 1 is configured as a module of a shelf system, which includes mounting rails 9 extending parallel to each other, onto which the feed device 1 can be pushed. For this purpose, the feed device 1 includes through holes 13 in the circumferential rim 100 in the vicinity of its front side and its rear side, into which the mounting rails 9 can be introduced, so that the mounting rails 9 extend transverse to the longitudinal side of the storage area 10 or the feed device 1. Accordingly, for example, a plurality of identically formed feed devices 1 can be pushed onto the mounting rails 9 one beside the other transverse to their guideway 12, in order to form an automated shelf system.

The illustrated embodiment in addition includes a partition 8 which is mounted on one of the longitudinal sides of the feed device 1. The partition 8 extends along almost the entire length of a longitudinal side of the feed device 1 and protrudes beyond its storage area 10. In this way, a spatially separate positioning of goods is achieved when using a plurality of feed devices 1 within one shelf system for different products each on one feed device 1.

Figure 2:
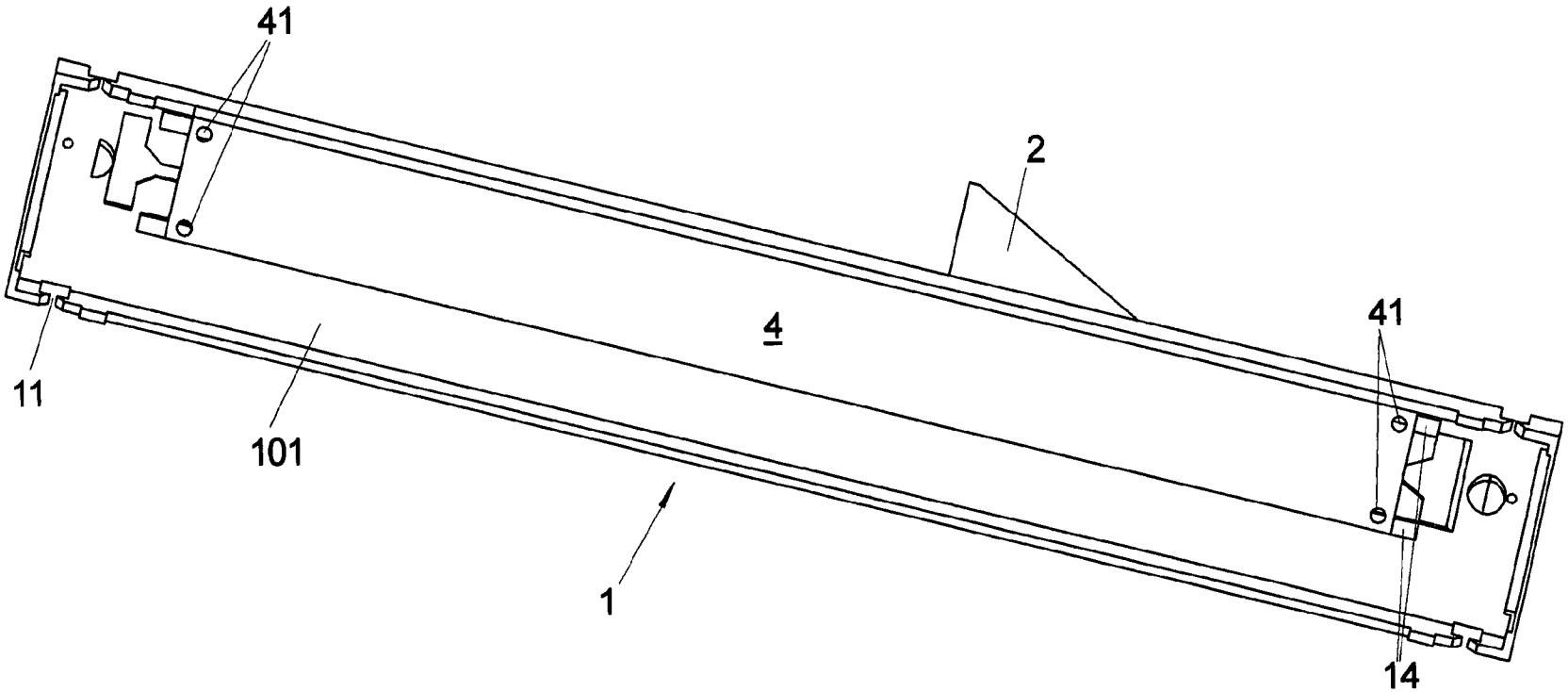
FIG. 2 shows a perspective view of the bottom surface of the embodiment of a feed device.

A bottom surface 101 of the feed device 1 as shown in FIG. 2 illustrates the modular structure of the feed device 1. On the bottom surface 101, an electronic component configured as printed circuit board 4 for the electronic, pulse-controlled detection of the shifting path of the feed unit 2 in accordance with the invention is introduced into two guide rails 14 extending parallel to the longitudinal side of the feed device 1 and fixed to the same, respectively. In this connection, apertures 41 in the printed circuit board 4 can serve as fastening connections both for the line connection to a non-illustrated evaluation unit, which evaluates the pulses generated, and for connection to a power source which supplies electricity to the conductors 401 arranged as contact means on the surface of the printed circuit board 4 facing the bottom surface 101.

The printed circuit board 4 can be fixed at the bottom surface 101 of the feed device 1 in various ways. In the illustrated embodiment, the printed circuit board 4 is riveted, screwed or glued to the guide rails 14. Alternatively, at least portions of the guide rails 14 can form two opposed channels. In these channels, which are L- or U-shaped in cross-section, the longitudinally extending (parallel to the direction X) lateral edges of the printed circuit board 4 are enclosed or accommodated. In this way, the printed circuit board 4 is positively held at the bottom surface 101 of the feed device 1 and can for example also be pushed into the feed device 1 without using a tool.

Figure 3:
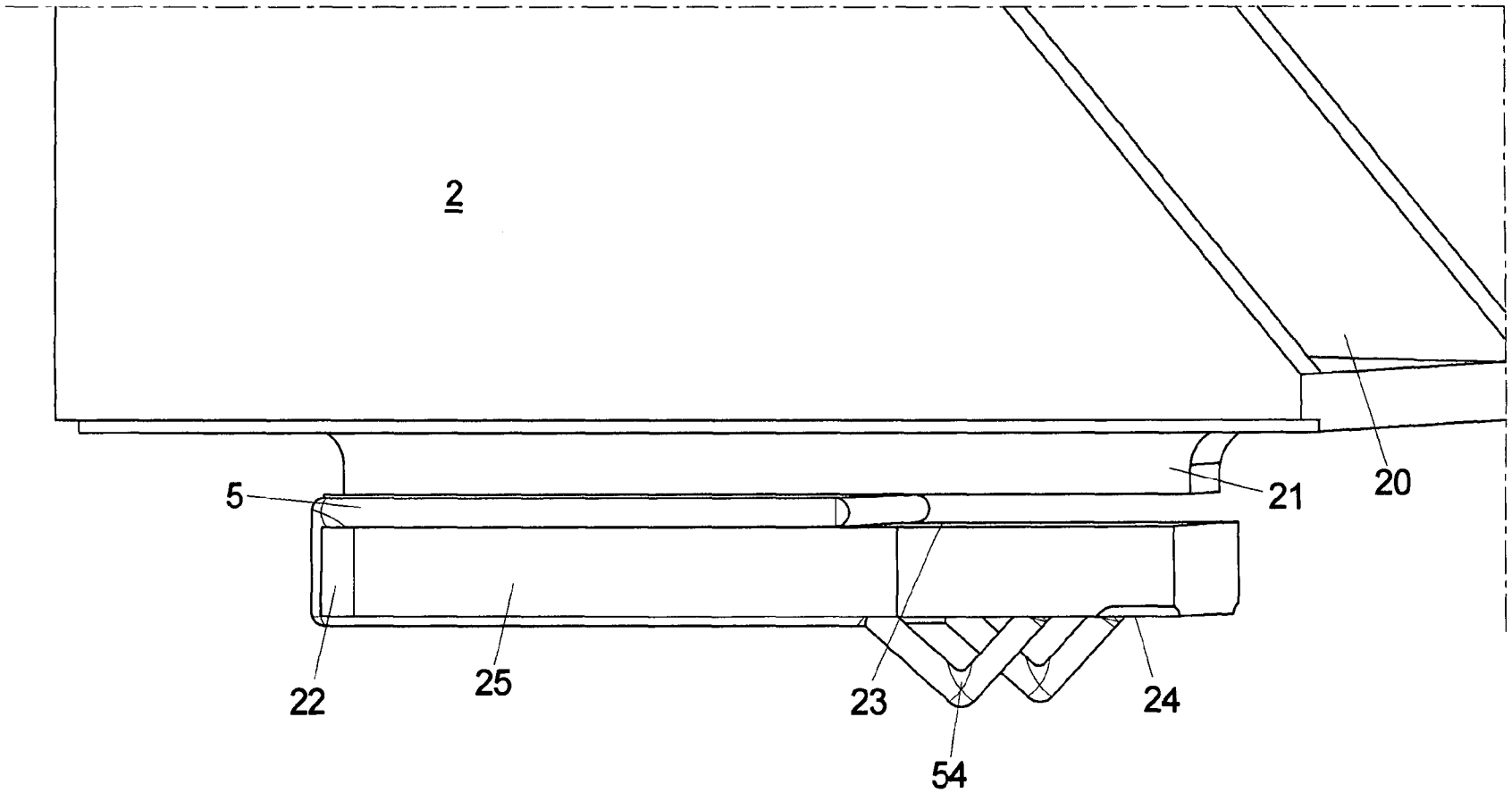
FIG. 3 shows a perspective detailed view of the feed unit with a contact spring mounted thereon as a contact element.

FIG. 3 shows the feed unit 2 of the preceding Figures in a detailed side view. The feed unit 2 forms a receptacle 20 for accommodating e.g. an evaluation unit and/or a drive, such as the wound tension spring 3. The receptacle 20 is configured as a cavity in the feed unit 2 bordered by three side walls of the feed unit 2. In this way, one of the components mentioned above by way of example (evaluation unit, drive) can be inserted into the feed unit 2 quickly and easily.

Placing and retrofitting an evaluation unit for the feed device 1 likewise becomes possible in a simple way. For example, it can be provided to provide a plurality of identically formed feed devices 1 within a shelf system and equip only one of the feed devices 1 with a central evaluation unit within a feed unit 2. This one evaluation unit then can be mounted subsequently in the desired feed device 1 or feed unit 2. Alternatively, a separate evaluation unit can be associated to each feed unit 2, which inside its respective receptacle 20 is shifted together with the feed unit 2 along its direction of adjustment (e.g. in direction X).

Furthermore, the feed unit 2 includes a guide portion 21 guided in the guideway 12 of the storage area 10. The same protrudes substantially vertically below the feed unit 2. Subsequently, a shoulder 25 with a groove 23 as spring seat is provided, into which a portion of a contact element in the form of a contact spring 5 can be inserted.

In the assembled condition of the feed device 1, the guide portion 21 with the shoulder 25 is located in a channel extending longitudinally below the storage area 10, which laterally is defined by the two guide rails 14, 14 and transverse thereto by the printed circuit board 4 on the one hand and by the bottom surface of the storage area 10 on the other hand. In this channel, the contact spring 5 pushed or inserted into the groove 23 is guided along the printed circuit board 4 together with the moving feed unit 2.

The contact spring 5 formed of a cylindrical conductor material is configured such that it encloses the shoulder 25 and rests against a stop 22 of the shoulder 25. On a bottom surface 24 of the shoulder 25 facing the printed circuit board 4, the contact spring 5 substantially forms two spaced triangular protrusions as spring contacts 54, 54. During a movement of the feed unit 2, these spring contacts 54, 54 as contact regions of the contact spring 5 contact conductors 401 or conductor portions of the printed circuit board 4 arranged at predefined distances S with respect to each other, which are raised with respect to the surrounding surface of the printed circuit board 4. When contacting the spring contacts 54, the conductors 401 and the contact spring 5 are electrically connected with each other and an electric pulse is detected. Thus, in a current-carrying printed circuit board 4 a pulse each becomes detectable in a known manner, when the feed unit 2 has covered the predetermined distance between the individual conductors 401. Via the amount of pulses detected altogether, it can then be inferred how many goods have been removed or how many goods still are present on the storage area 10.

According to the invention, the individual contact means in the form of the conductors 401 are (at least partially) designed differently so that during adjustment of the feed unit 2 along its adjustment path (e.g. in adjustment direction X) pulses, which are distinguishable from each other, and therefore—if applicable—a sequence of pulses characteristic for the respective adjustment direction are generated due to a contact with the contact spring 5, when the feed unit 2 is passed over several conductors 401 during its movement.

It can also be provided that during the electrical connection of the contact spring 5 and a conductor 401, which thus have been brought in operative contact with each other, pulses of different strength are generated and evaluated. This can be achieved each by a different configuration of all or part of the conductors 401. Thus, during connection with the contact spring 5 via their spring contacts 54, 54, the same can form different total resistances. In this way, an exact position along the printed circuit board 4 can be associated to individual or all conductors 401 of a printed circuit board 4, or a pulse generated can directly be associated to a specific position of the feed unit 2 on the storage area 10.

To avoid in such case that all conductors 401 must be designed for generating different pulses, a position determination can also be obtained by measuring certain pulse sequences. This means for example that different types of conductors 401 are arranged on a printed circuit board 4, with each type of conductor 401 generating a pulse characteristic for this type of conductor 401 when contacting the spring contacts 54, 54 of the contact spring 5.

Alternatively, there can be an attribution of individual conductors 401 to one of several electric circuits, which are respectively closed upon contact with the spring contacts 54, 54. By measuring which one of the possible electric circuits was closed (or the one last-closed) or in which order electric circuits separated from each other were successively closed, not only a current position of the feed unit 2 but also likewise a direction of movement of the feed unit can then be determined.

When the arrangement of the different conductors 401 on the printed circuit board 4 now is stored in an evaluation unit, e.g. an exact, current (end) position of the feed unit 2 can be determined after the movement of the feed unit 2 along the storage area 10 via the related generation of a pulse sequence characteristic for the distance covered. This is also feasible without specifying or storing a reference or start position of the feed unit 2 in an electronic evaluation unit and automatically permits the determination in what direction the feed unit has been shifted.

In addition, a position determination is possible with consistently formed conductors 401 on a printed circuit board 4. A reference position or start position of the feed unit 2—e.g. along a specific section or intermediate portion of the printed circuit board 4—is stored in an evaluation unit. This start position, as start of the section or intermediate portion with consistently or identical conductors 401, can for example be defined by a conductor specifically designed, e.g. having an especially low resistance. Via the number of (identical) pulses subsequently measured, the distance of the feed unit 2 along the storage area 10 from this reference or start position and hence the number of goods or goods packages still present on the storage area 10 or removed from the storage area 10 can be determined unambiguously. If a specifiable number of pulses is detected, which indicates the complete removal of all goods or goods packages present on the storage area 10, an evaluation unit generates a corresponding signal. In this way, a user is informed of the sale of the goods or goods packages arranged on the storage area 10. In this respect, a section of the printed circuit board 4 having conductors 401 consistently formed would advantageously be an end of the printed circuit board directed towards the front stop.

By mixing sections having conductors which are arranged one behind the other and are consistently formed with sections having conductors which are arranged one behind the other and are different from each other, the range of applications for a feed device 1 according to the invention and the parameters which may be measured during a movement of the feed unit 2 increase significantly.

Alternatively or in addition, an atypical removal operation can be detected by the feed device 1 of the invention due to the pulse frequency measured by the evaluation unit or a subsequent calculating unit. This can be utilized for example to detect a theft of goods or goods packages present on the storage area 10, in which the goods or goods packages usually are removed from the storage area 10 in a large number and/or in quick succession.

Figure 4:
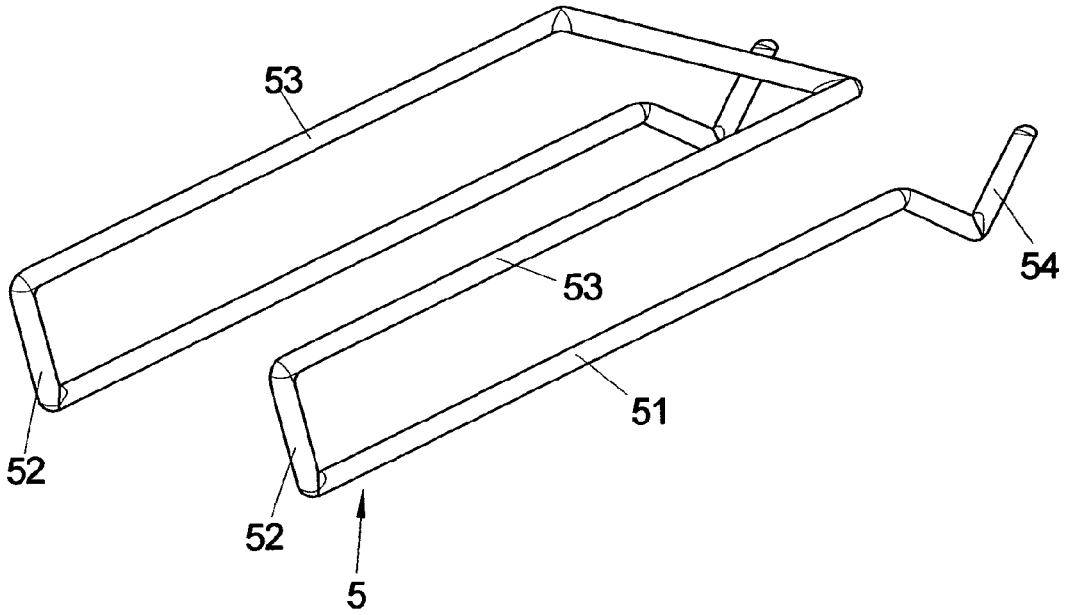
FIG. 4 shows the contact spring of FIG. 3 in a perspective detailed view.

FIG. 4 shows the contact spring 5 in a perspective detailed view. It is not dissimilar to a multiply bent wire and mirror-symmetrical along a median plane, which in the mounted condition would extend parallel to the guideway 12. It includes the spring contacts 54, 54 at its two ends located parallel to each other. Subsequent to a lower portion 51 likewise extending in parallel, which would rest on the bottom surface 24 of the shoulder 25, a vertically extending portion 52 is provided, which must be positioned at the stop 22 of the shoulder 25 and in the mounted condition of the contact spring 5 rests against this stop 22. An upper portion 53 of the contact spring 5, which again extends parallel to the lower portion 51, then each forms a region of the contact spring 5, which can be inserted into the groove 23 of the shoulder 25 of the feed unit 2. The two upper portions 53 are connected with each other via a portion of the contact spring 5 extending transverse to the same, so that the contact spring 5 is formed of a continuous, multiply bent conductor material, whose two ends form the contact springs 54, 54.

Figure 5:
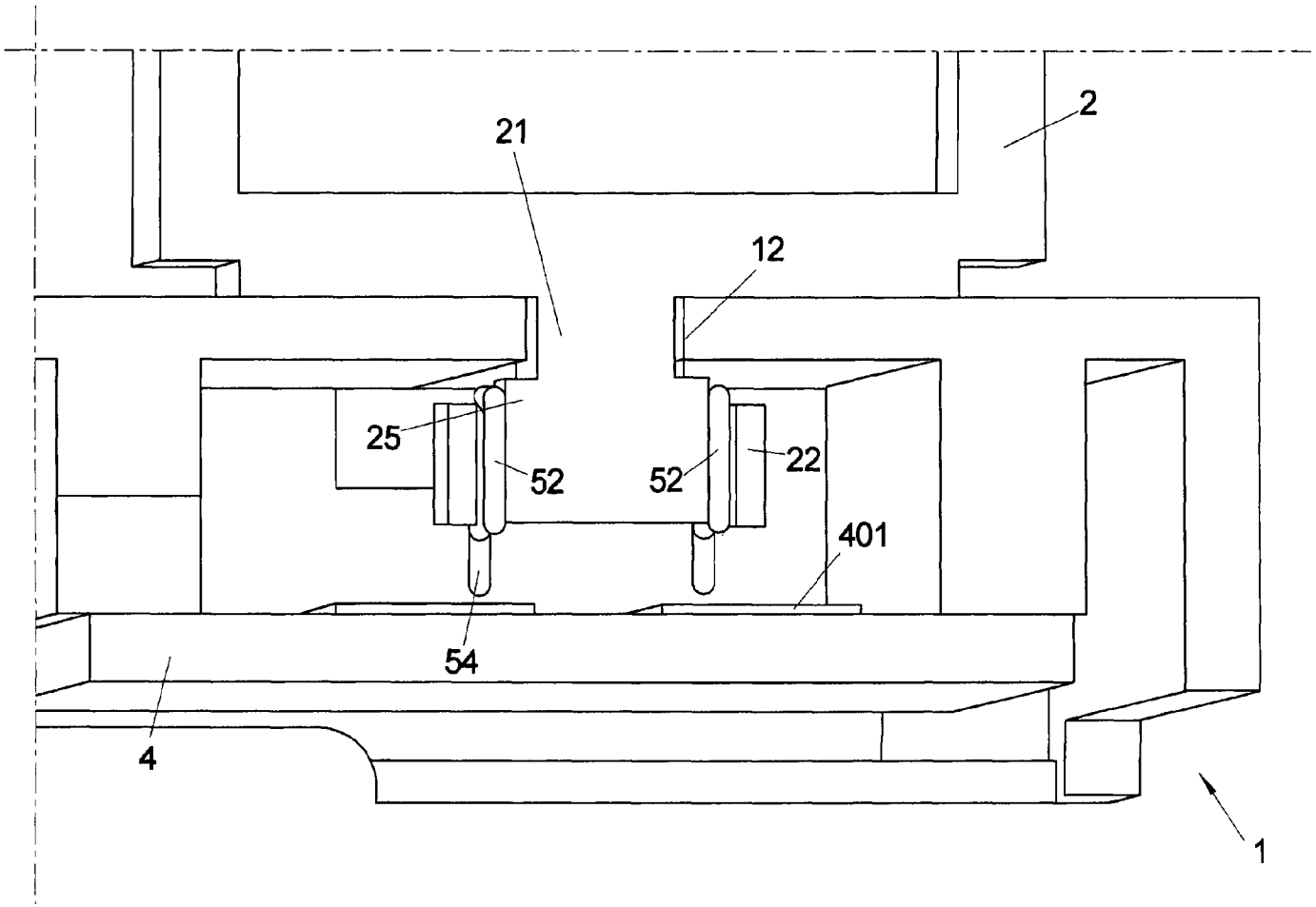
FIG. 5 shows a perspective view of the rear side of a feed device.

FIG. 5 shows a perspective view of the rear side of a feed device 1. With the feed unit 2 guided in the guideway 12 and with the contact spring 5 mounted on its shoulder 25, the mode of operation of the illustrated feed device 1 can be shown in greater detail. The printed circuit board 4, which is mounted on the feed device 1 below the shoulder 25 of the feed unit 2, includes elevations pointing in the direction of the shoulder 25. The same represent the conductors 401 arranged on the printed circuit board 4 in the form of a raster 40. During a movement of the feed unit 2, the spring contacts 54 now are guided along the printed circuit board 4. Upon contact with the conductors 401, a pulse now is each detected. Since the conductors 401 are integrated on the printed circuit board 4 at a known distance from or in a known arrangement with respect to each other, each pulse detected can directly be associated to a distance S covered by the feed unit 2.

Figure 6A:
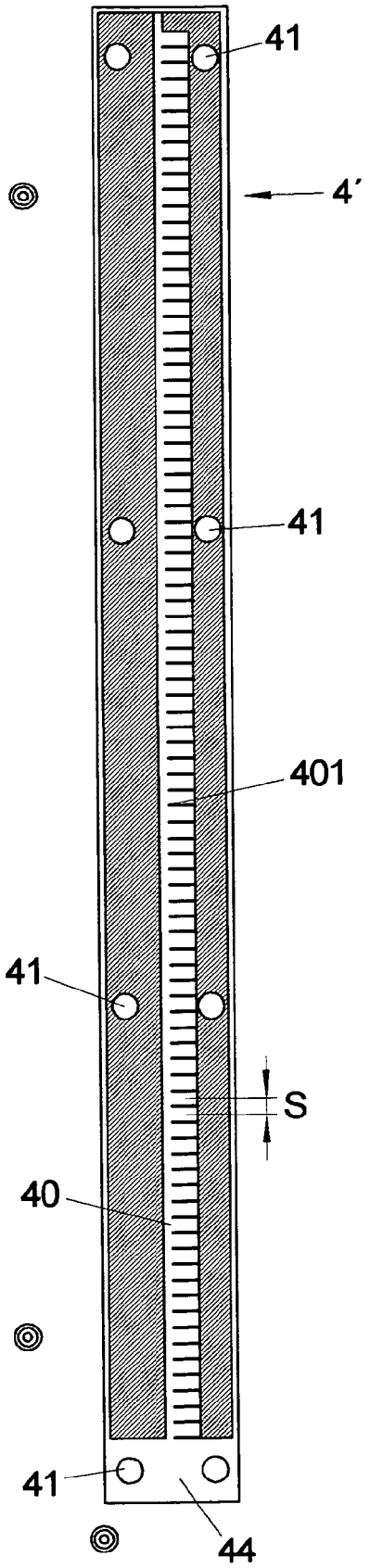
FIGS. 6A-6E show various embodiments of a printed circuit board as an electronic component with a raster of conductors as contact means in a top views.
Figure 6B:
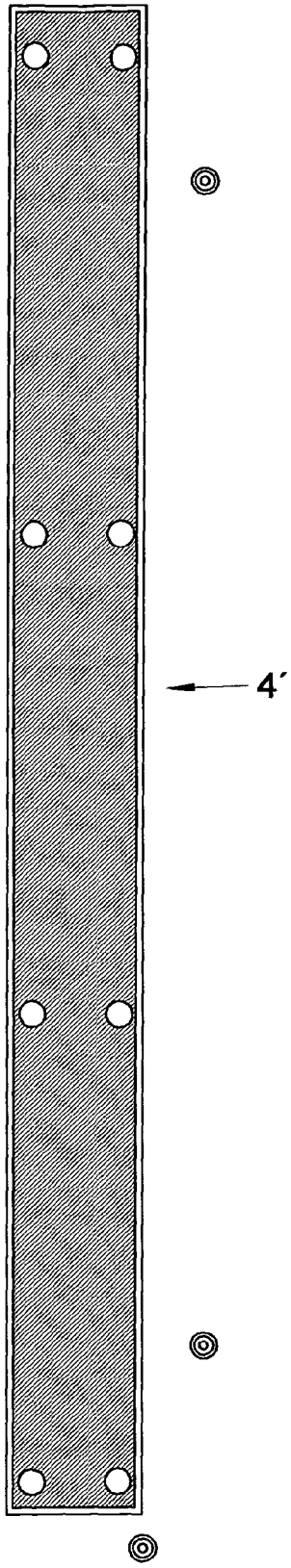
Figure 6C:
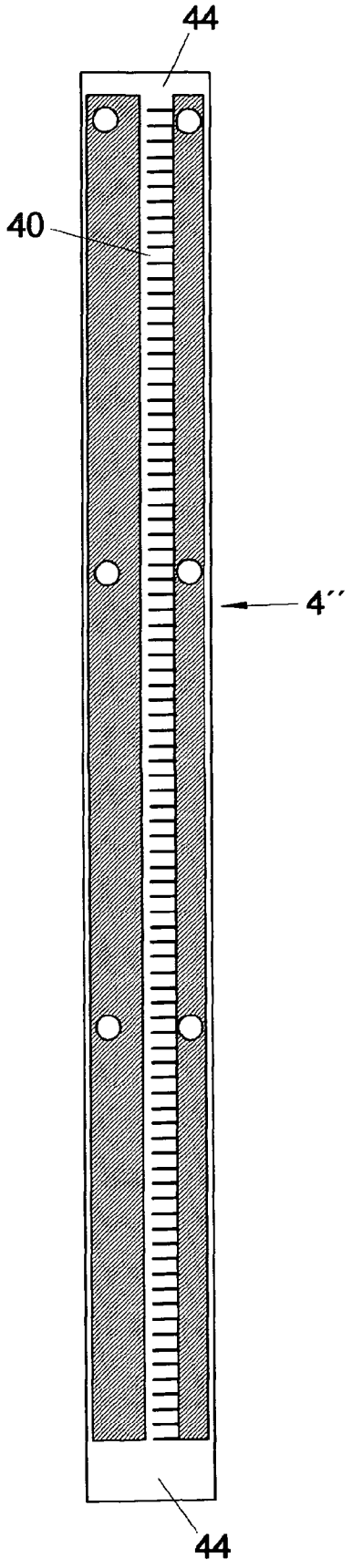
Figure 6D:
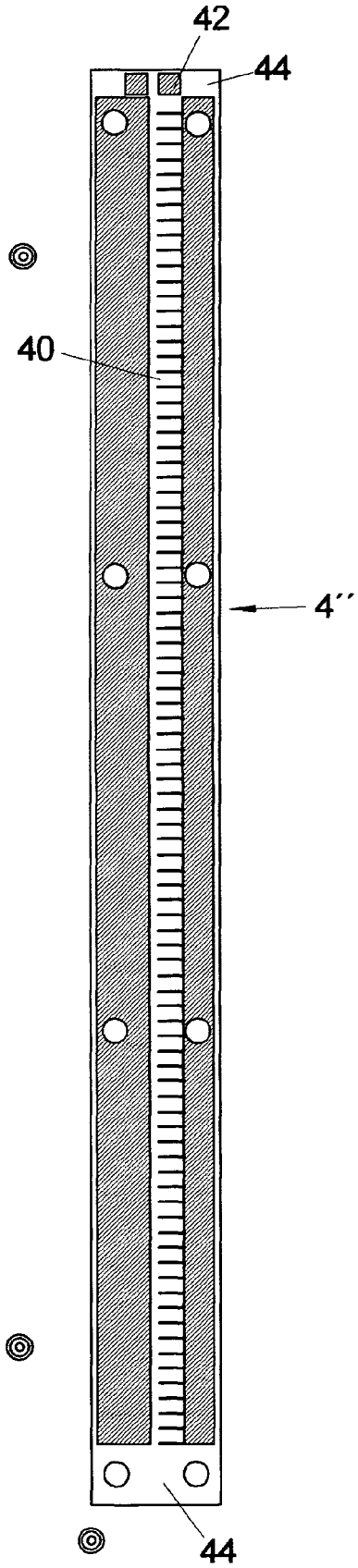
Figure 6E:
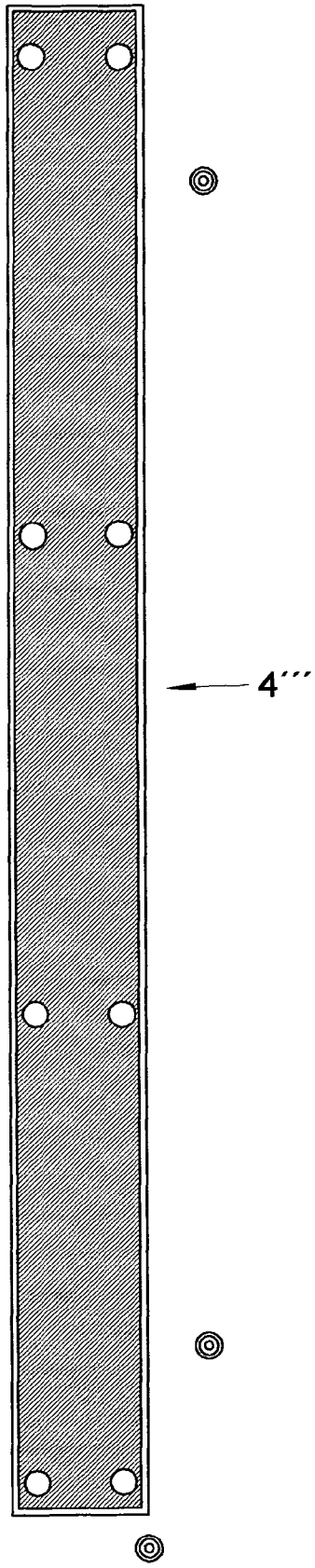

FIGS. 6A to 6E illustrate different configurations of printed circuit boards 4', 4" and 4'" with rasters 40 disposed thereon. While FIGS. 6A and 6B as well as 6D and 6E each show a top view of two embodiments "from above" and "from below", FIG. 6C only shows the top view of the upper surface of an alternatively configured printed circuit board 4. Essential differences of the preferably printed rasters 40, which are arranged on the upper surfaces of the printed circuit boards 4', 4" and 4'" as shown in FIGS. 6A, 6C and 6D, primarily are obtained in the configuration of clamping regions 44 at the ends of the longitudinally extending printed circuit boards 4', 4" and 4'" and of hook-in openings 42 for the simplified attachment of the printed circuit board 4', 4" or 4'". In the present embodiments, the raster 40 of the conductors 401 is configured as a continuous, longitudinally extending conductor, from which individual conductors 401 protrude perpendicularly at the distance of a predefined path length S.

Figure 7:
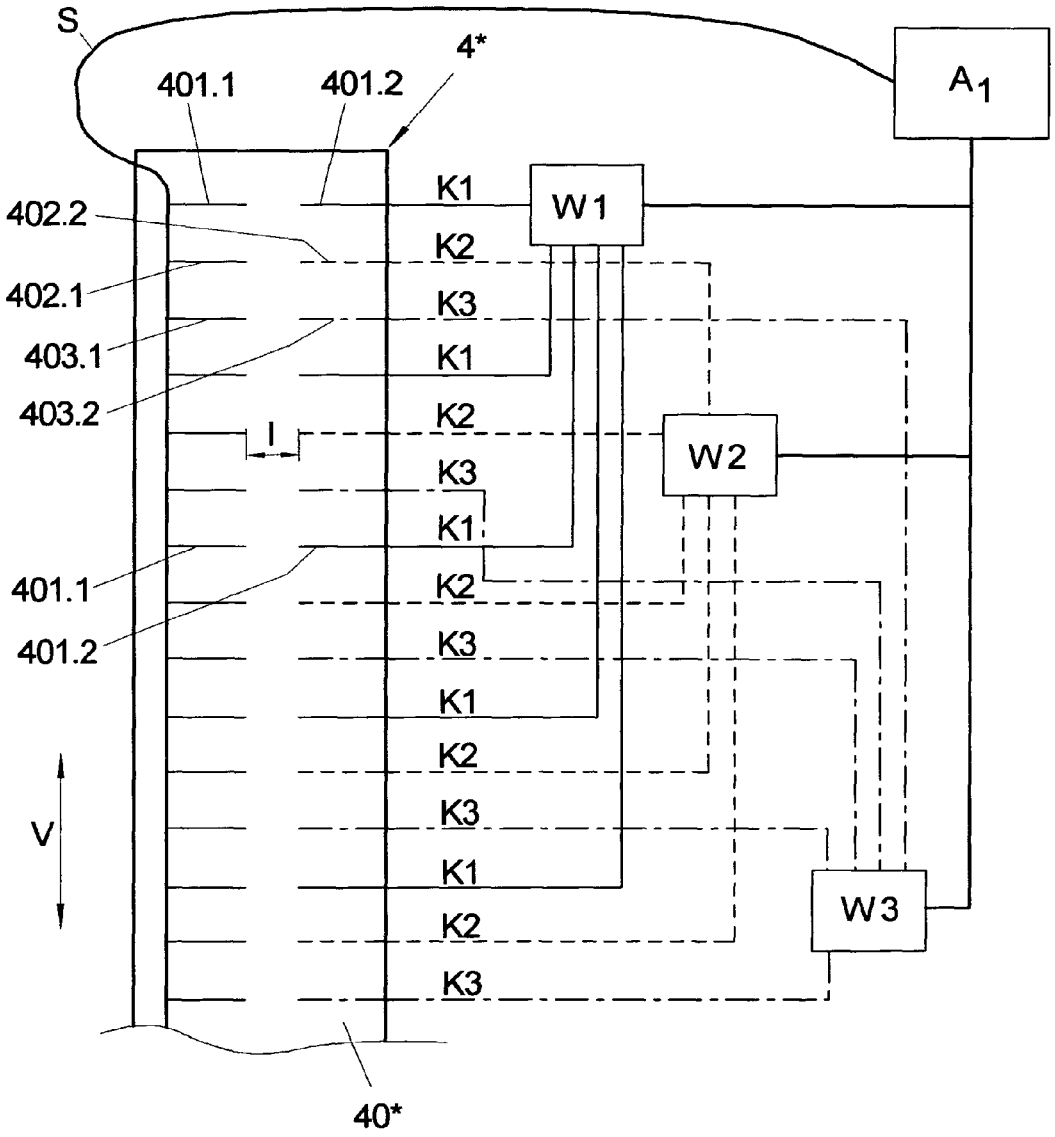
FIG. 7 schematically shows an electronic component in the form of a printed circuit board with different contact means which are respectively connected to a single one of several (three) resistors.
Figure 8:
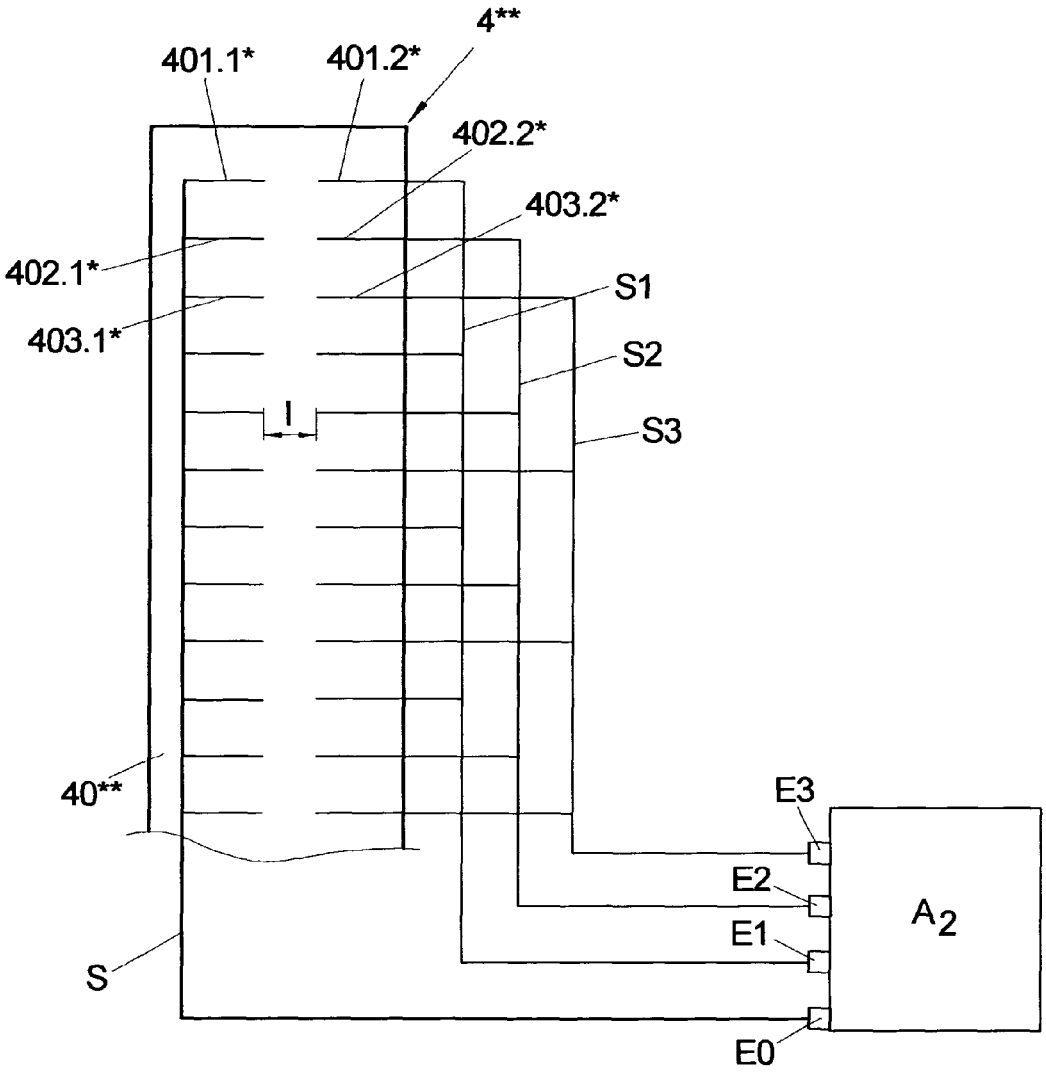
FIG. 8 schematically shows an electronic component in the form of a printed circuit board with different contact means which are respectively assigned in groups to different electric circuits.

FIGS. 7 and 8 in each case furthermore schematically illustrate two embodiments of an electronic component in the form of a printed circuit board 4*(FIGS. 7) and 4 (FIG. 8), which may be employed in a feed device 1** according to the invention.

FIG. 7 shows a printed circuit board 4* in top view at which again a raster 40* made up of contact means in the form of conductor portions 401.1, 401.2; 402.1, 402.2 and 403.1, 403.2 is arranged, which contact means can be respectively contacted by the spring contacts 54, 54 of the contact spring 5. The conductor portions 401.1, 401.2; 402.1, 402.2 and 403.1, 403.2 respectively lie in pairs opposite to each other along the direction of extent of the printed circuit board 4* and are spaced apart from each other so that a gap having a gap width I is formed between each pair of conductor portions 401.1, 401.2; 402.1, 402.2 and 403.1, 403.2. A conductor defined by a pair of conductor portions 401.1, 401.2; 402.1, 402.2 or 403.1, 403.2 is hence respectively interrupted by an insulating gap.

The spring contacts 54, 54 of the contact spring 5 spaced apart from each other are configured such that they can conductively connect a pair of conductor portions 401.1, 401.2; 402.1, 402.2 or 403.1, 403.2 and that they can close an electric circuit therewith which is interrupted by the gap.

Furthermore, the individual pairs of conductor portions 401.1, 401.2; 402.1, 402.2 and 403.1, 403.2 are different from each other since one of its conductor portions (the second one) 401.2, 402.2 and 403.2 is respectively connected to one of several different electric resistors W1, W2 or W3. In an alternative, a pair of conductor portions 401.1, 401.2; 402.1, 402.2 and 403.1, 403.2 can also respectively define a different (total) resistance W1, W2 or W3.

In this embodiment it is of mere importance that both conductor portions 401.1, 401.2; 402.1, 402.2 and 403.1, 403.2 are respectively energized and that by bridging the gap by means of the conductive contact spring 5 of the feed unit 2 at least temporarily a measurable (electric) pulse is generated, which is measured and evaluated by an evaluation unit $A_1$ coupled to the printed circuit board 4*. For this purpose, the (first) conductor portions 401.1, 402.1 and 403.1 are connected to a common feeder S and the other (second) conductor portions 401.2, 402.2 and 403.2 are respectively connected to one of the resistors W1, W2, W3 via connecting lines K1, K2, K3 and to the evaluation unit $A_1$. Since the resistors W1, W2, W3 of the conductor portions 401.1, 401.2; 402.1, 402.2 and 403.1, 403.2 are different in size or in their resistance values, it can be determined on the basis of the amplitudes of the pulses measured at which one of the three different pairs the opposing ends of the conductor are currently connected to each other by the contact spring 5.

In fact, there is actually no limit for the number of different conductors or conductor portions to be arranged at the printed circuit board 4*. However, it was proven to be effective and economic to merely form three types or groups of different conductors or conductor portions on the printed circuit board 4* and to arrange them one behind the other in an alternating manner along the printed circuit board 4*. Thus, a pair of conductor portions 402.1, 402.2 of a second type (resistor W2) along the adjustment path V of the feed unit 2 always lies between a pair of conductor portions 401.1, 401.2 of a first type (resistor W1) and between a pair of conductor portions 403.1, 403.2 of a third type (resistor W3). The individual pairs of conductor portions 401.1, 401.2; 402.1, 402.2 and 403.1, 403.2 being consistently formed are thereby respectively connected to the evaluation unit $A_1$ via the resistors W1, W2 or W3, assigned to the respective group, and via the connecting lines K1, K2, K3.

An alternative for the design of different contact means at the electronic component of the feed device 1 is shown in FIG. 8 with the printed circuit board 4, at which in a manner similar to the printed circuit board 4* of FIG. 7 alternating pairs of conductor portions 401.1*, 401.2*; 402.1*, 402.2* and 403.1*, 403.2* as contact means are arranged, which conductor portions are again separated from each other by a gap. The conductor portions 401.1*, 401.2*; 402.1*, 402.2* and 403.1*, 403.2*, in contrast to the embodiment of FIG. 7** however, are not assigned to a single electric circuit, but in groups to a respective single one of several (in the present case three) separate electric circuits.

Every (first) conductor portions 401.1*, 402.1* and 403.1* are again solely connected to a common feeder S. The opposing (second) conductor portions 401.2*, 402.2* and 403.2* are in each case connected to an evaluation unit $A_2$ via one of three connecting lines S1, S2 and S3. Thereby, the ends of the feeder S and of the connecting lines S1, S2 and S3 are plugged in inputs E0, E1, E2 or E3 of the evaluation unit $A_2$. Preferably, the feeder S and the connecting lines S1, S2, S3 are installed together in a multi-conductor cable (in the present case having four conductors) so that a (modular) feed device 1 can be connected to an evaluation unit $A_2$ in a fast and simple manner.

The pairs, which are respectively assigned to one electric circuit, are again arranged in an alternating manner so that each pair of conductor portions 402.1*, 402.2* of a second electric circuit (connecting line S2) along the adjustment path V of the feed unit 2 always lies between a pair of conductor portions 401.1*, 401.2* of a first electric circuit (connecting line S1) and a pair of conductor portions 403.1*, 403.2* of a third electric circuit (connecting line S3).

If the feed unit 2, which may be adjusted along the printed circuit board 4, with its contact spring 5 bridges a pair of conductor portions 401.1*, 401.2*; 402.1*, 402.2* or 403.1*, 403.2* the respectively assigned electric circuit is closed and a (electric) pulse is detected in the evaluation unit $A_2$ at one of the inputs E1, E2 or E3**.

With this arrangement, an evaluation of the pulse amplitudes detected may be omitted in order to identify a current position or a direction of movement of the feed unit 2. In contrast, it can be determined on the basis of one or several binary variable(s) of state for a respective group of conductor portions 401.1*, 401.2*; 402.1*, 402.2* and 403.1*, 403.2* where the feed unit 2 is currently positioned and/or in which direction it moves. If e.g. a pulse was successively registered at the inputs E1 and E2 or E2 and E3 or E3 and E1 and therefore in each case a variable of state was activated or deactivated for said inputs, it can be determined that the feed unit recently has moved towards the front stop in adjustment direction X due to the order of the changed variables of state. In contrast thereto, successive pulses at the inputs E2 and E1 or E3 and E2 or E1 and E3 would indicate a movement of the feed unit 2 in the opposite adjustment direction −X.

With the embodiment of FIG. 7 as well as with the embodiment of FIG. 8 a plurality of pulses being distinguishable from each other and a sequence of pulses respectively characteristic for one direction of movement of the feed unit 2 may be generated due to the different contact means in the form of the conductor portions 401.1*, 401.2*; 402.1*, 402.2* and 403.1*, 403.2*. In addition to the evaluation of a frequency and of a number of the pulses measured, this configuration also allows deducing in which direction a feed unit 2 within the feed device 1 moves.

In an embodiment the evaluation unit $A_1$, $A_2$ is configured and adapted to store a last-measured or last-detected pulse value and/or a last-evaluated sequence of pulses or a value representative therefore or several values representative therefore, so that already on the basis of the detection of a further single pulse, due to the interaction of the contact spring 5 (or the tension spring 3*a*, as will be described below) with a pair of conductor portions 401.1*, 401.2*; 402.1*, 402.2* and 403.1*, 403.2*, may be determined in which direction the feed unit 2*a* has currently moved along the adjustment path V.

In an embodiment, the evaluation unit $A_1$, $A_2$ can furthermore comprise an analog digital converter for the evaluation of the pulses generated at the electronic component in the form of the printed circuit board 4, 4', 4", 4''', 4*, 4**.

FIGS. 9A-9B, 10A-10B and 11 illustrate further embodiments of a feed device 1 according to the invention. These embodiments differ from the alternatives previously discussed merely with respect to the design and configuration of the contact element. Whereas the contact element in the figures previously shown was a contact spring 5 which may be plugged onto the feed unit 2, a resetting element in the form of a windable tension spring 3*a* is used as a contact element for the pulse generation in the embodiments of FIGS. 9A-9B, 10A-10B and 11. The tension spring 3*a* thereby extends underneath the objects G arranged on the storage area 10, which objects are thus positioned above a top surface 30*a* of the tension spring 3*a*.

The tension spring 3*a* applies a resetting force to the feed unit 2—like the tension spring 3 of the previous embodiments—which resetting force acts in direction X towards a front stop F along the adjustment path V of the feed unit 2. The feed unit 2 is driven by the tension spring 3*a* and due to the tension spring 3*a* the goods G arranged on the storage area 10 and in front of the feed unit 2 are moved towards the front stop F. For this purpose, the strip-like tension spring 3*a* is mounted within a receptacle 20 of the feed unit 2, so that it may be wound and unwound, and is fixed with one end to the feed device 1 in the area of the front stop F. The fixation is thereby realized at a securing location 32*a* of the tension spring 3*a*.

Depending on the distance of the feed unit 2 from the front stop F and hence depending on the goods G arranged between the front stop F and the feed unit 2, the tension spring 3*a* extends with a portion of a specific length L from the front stop F to the feed unit 2 along the adjustment path V. This length L extending substantially rectilinearly along the adjustment path V varies upon movement of the feed unit 2 along the adjustment path V. If the feed unit 2 is moved away from the front stop F, the length L of the portion of the tension spring 3*a* extending along the adjustment path V increases. If, in contrast thereto, the feed unit 2 is moved toward the front stop F, the length L shortens.

Figure 9A:
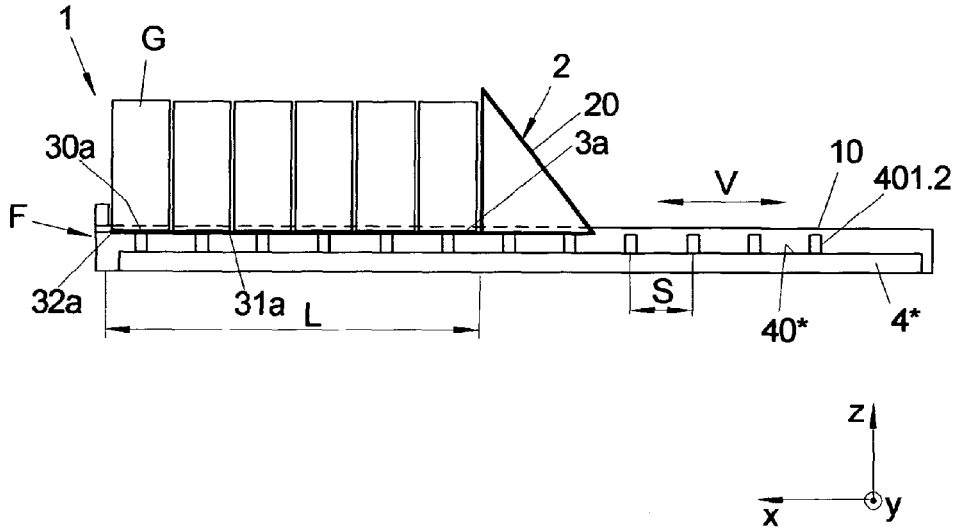
FIGS. 9A-9B show in different views a further embodiment of a feed device according to the invention, in which a resetting element for driving the feed unit is used as a contact element.
Figure 9B:
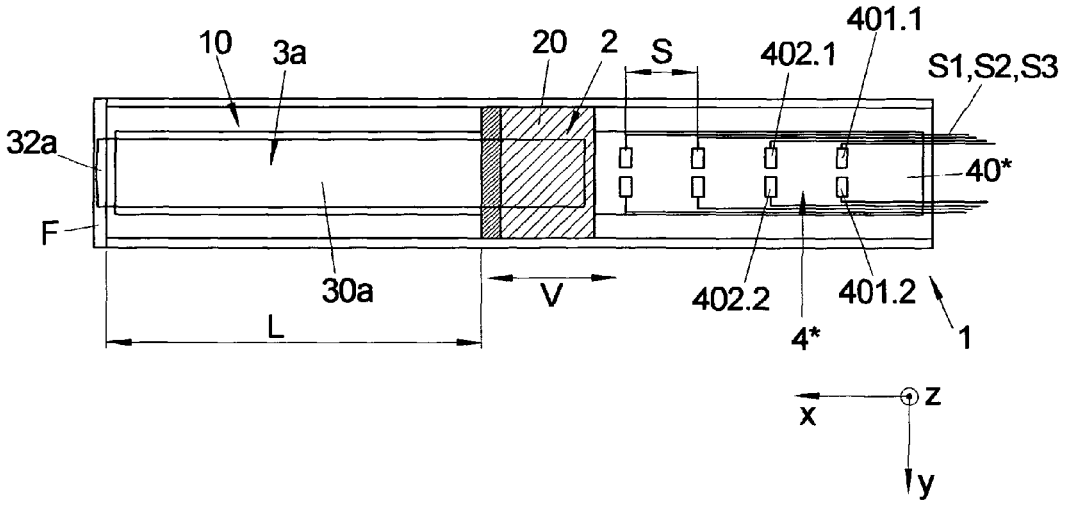

The portion with the length of the tension spring 3*a*, extending along the adjustment path V and substantially parallel to the storage area 10, and having a rectangular shape according to FIG. 9B, is herein used instead of the contact spring 5 for generating pulses during a movement of the feed unit 2. The tension spring 3*a* hence does not only function as a drive for the feed unit 2, but also as a part of a electronic sensor assembly by means of which in particular the position of the feed unit 2 along the adjustment path V, the number of goods G being present between the front stop F and the feed unit 2 and the direction of movement of the feed unit 2 can be determined. For this purpose, the tension spring 3*a* with its length L extending along the adjustment path V interacts with the electronic contact means (e.g. the conductor portions 401.1, 401.2; 402.1, 402.2 and 403.1, 403.2 of FIGS. 9A-9B and 10A-10B or the conductor portions 401.1*, 401.2*; 402.1*, 402.2* and 403.1*, 403.2* of FIG. 11). The contact means are here respectively designed as projecting conductors or conductor portions on the printed circuit board 4, 4', 4", 4''', 4* or 4**.

The printed circuit board (in this case e.g. 4* or 4) is secured within the feed device 1 in such a way that the unrolling resetting element in the form of the tension spring 3***a* may lay down on the contact means. Over its (effective) length L the tension spring 3*a* hence contacts a specific number of contact means with a contact surface 31*a* at its bottom side depending on a position of the feed unit 2 along the adjustment path V, wherein the contact surface faces the printed circuit board and runs parallel thereto. In the present case, the tension spring 3*a* is electrically conductive at least at those sections which during normal operation can extend along the adjustment path V in order to electrically connect at least two opposing conductor portions defining a contact means and to thereby respectively generate a (new) characteristic and distinguishable pulse after the feed unit 2 has covered a predefined distance S. In this respect, the tension spring 3*a* may e.g. be entirely made up of a electrically conductive material or may be electrically conductive only in those sections which can lay down on the respective contact means in the form of the conductor portions 401.1, 401.2; 402.1, 402.2 and 403.1, 403.2 or 401.1*, 401.2*; 402.1*, 402.2* and 403.1*, 403.2*.

Figure 10A:
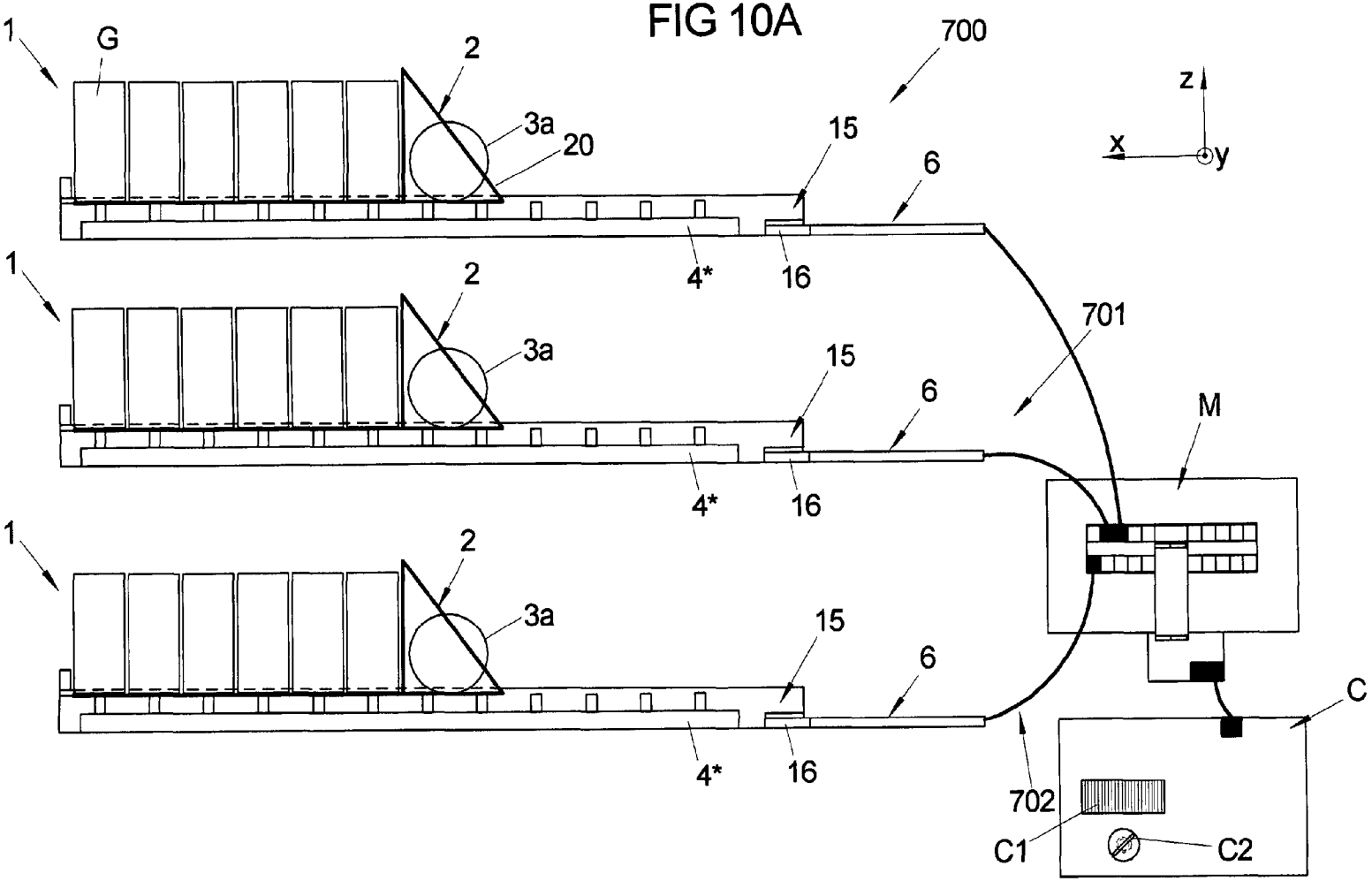
FIG. 10A shows a shelf system having several shelves which are arranged one upon the other and which in each case comprise several feed devices.
Figure 10B:
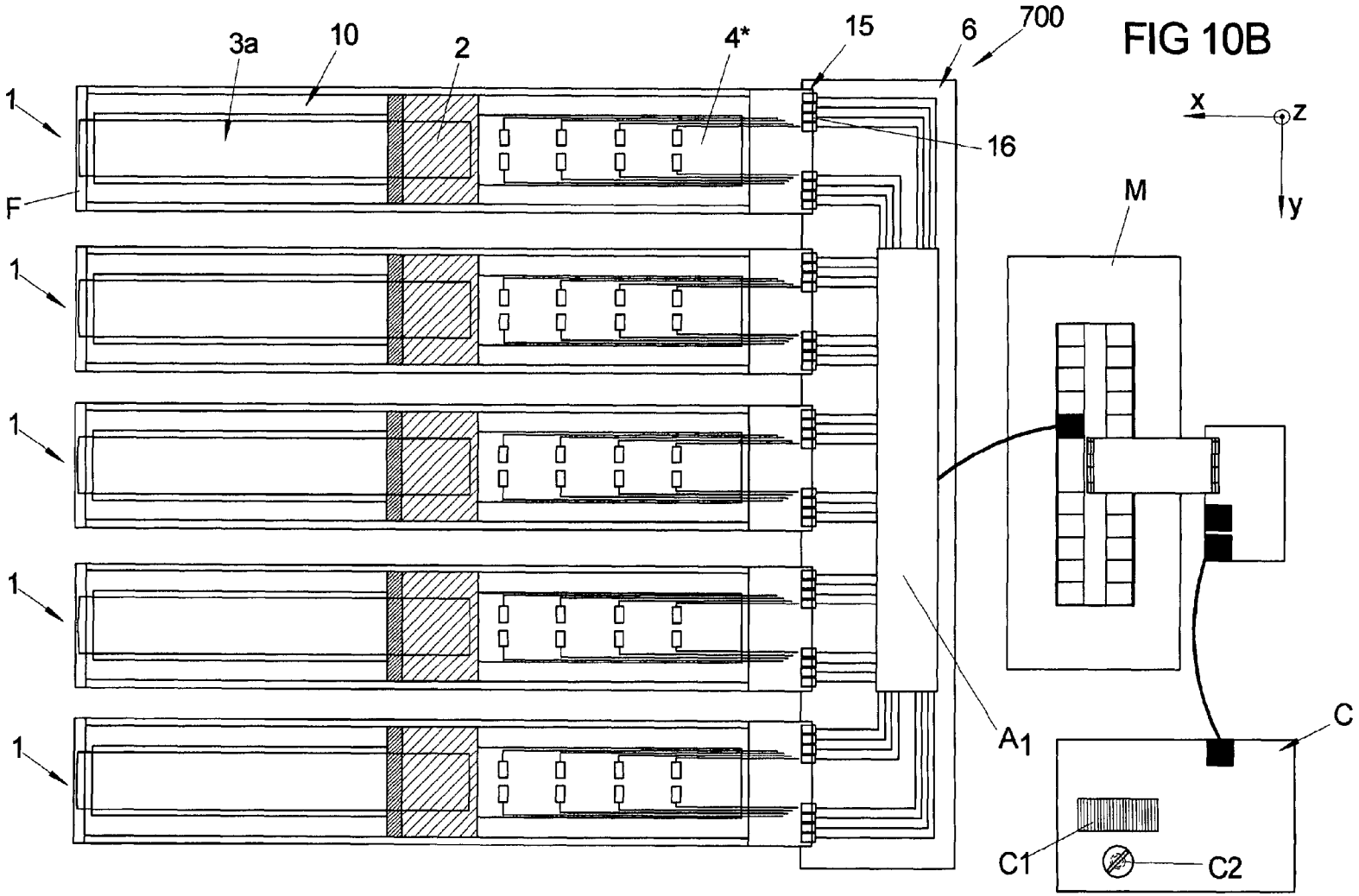
FIG. 10B shows a top view of a shelf of FIG. 10A.
Figure 11:
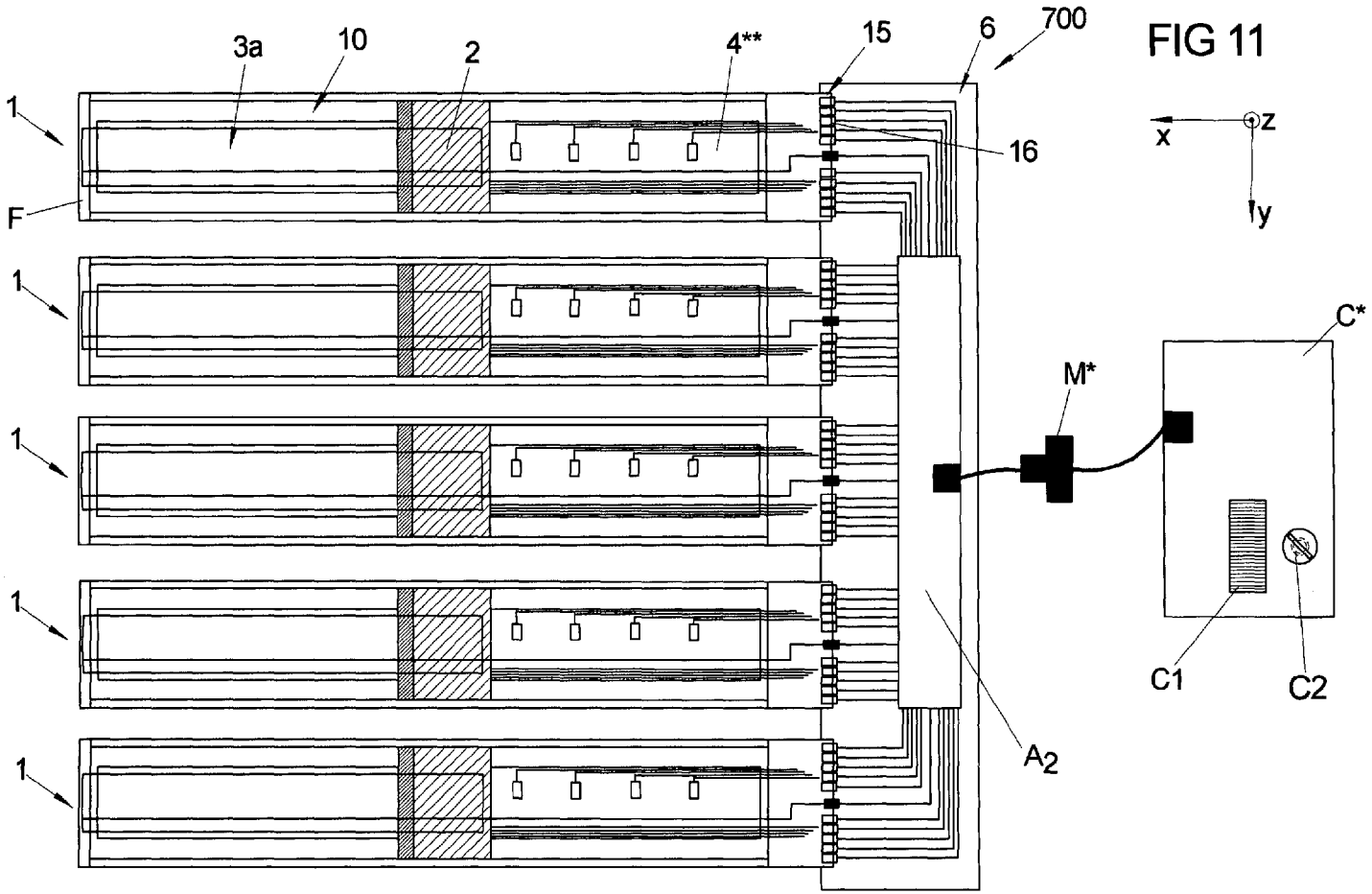
FIG. 11 shows a top view of a shelf with evaluation and control units changed with respect to FIGS. 10A and 10B.

In FIGS. 10A-10B and 11 possible embodiments of a shelf system are shown having several shelves 700, 701 and 702 being arranged one upon the other. Each shelf 700, 701, 702 comprises a plurality of feed devices which are mounted one beside the other and parallel to each other, each feed device being designed identically to the embodiments previously described as regards their mode of operation.

At one end of the storage area 10 and the adjustment path V being opposite to the front stop F, each of the individual feed devices 1 comprises a connection plug board 15 at which connecting or signal lines end. Via the connection plug board 15 each of the feed devices is respectively connected to a control circuit board 6 on which an evaluation unit $A_1$, $A_2$ having a evaluation logic is accommodated, in order to evaluate the pulse or the sequence of pulses generated during movement of the feed unit 2.

Each connection plug board 15 is connected to the control circuit board 6 by a detachable connection. In the present case, the detachable connection is realized by a simple click- or plug-type connection 16. In this way, a single feed device 1 can be entirely removed from a shelf in a uncomplicated and fast way and—if needed—may be changed, in both cases without the need of connecting the control circuit board 6 to a feed device 1 via separate cables or wires. The control circuit board 6 of a shelf 700, 701, 702, which control circuit board extends transversely with respect to the adjustment path V and transversely with respect to the direction of extent of the feed device 1, is in the present case not only used for supplying an electric current to the printed circuit board connected therewith in the feed devices 1 and for evaluating the pulses generated. The control circuit board 6 is rather as well coupled to a control module M (FIGS. 10A-10B) or M* (FIG. 11), which e.g. is a electronic connection device for nodes of a computer network or a data processing unit.

A superordinated data processing unit or control unit C, C* is furthermore (wirelessly or by wire) coupled to the control module M, M*, wherein the control unit e.g. outputs, forwards, reprocesses and/or displays the data measured and evaluated. Each control unit C, C* of the embodiments shown in FIGS. 10A-10B and 11 comprises a display means C1 in the form of a display and an actuating element C2 e.g. in the form of a key or switch via wherein the shelf system can be activated and deactivated and/or an electronic filling level and/or theft surveillance for the entire shelf system or individual shelves 700, 701, 702 can be activated and deactivated via the actuating element C2.

Figure 12:
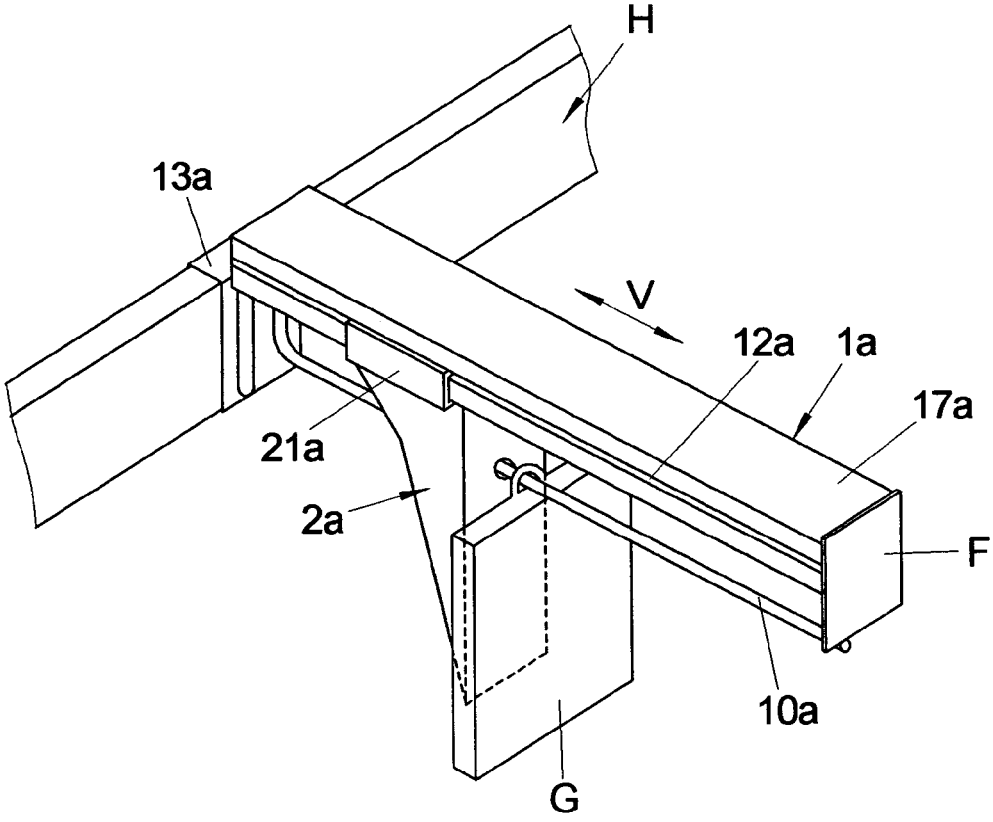
FIG. 12 shows a perspective view of a further embodiment of a feed device according to the invention having a feed unit which is movable along a holding element.

FIG. 12 shows a perspective view of a further embodiment of a feed device 1*a* according to the invention which comprises a feed unit 2*a* being movable along a holding element 10*a*.

The holding element 10*a* of the feed device 1*a* is designed for this purpose as a shelf hook at which goods or goods' packages G are hooked. Above the holding element 10*a* extends a narrow housing 17*a* of the feed device 1*a* in which one of the previously described printed circuit boards 4, 4', 4", 4''', 4*, 4** as electronic component is accommodated and secured.

On the lines of the previously described embodiments, the feed unit 2*a* pushes the goods packages G, which are arranged in a row one behind the other and in front of the feed unit 2*a*, towards the front stop F, wherein, due to an operative contact with the respective electronic component, a characteristic pulse is generated during a movement of the feed unit 2*a* along the holding element 10*a* and along the adjustment path V defined therewith, and after a predefined distance S is covered. The feed unit 2*a* is thereby guided at the housing 17*a* via two opposing longitudinal guideways 12*a* in the form of longitudinal grooves, in which a guide portion 21*a* respectively engages on opposite sides of the housing 17*a*, wherein the guide portion is a part of a U-shaped basis of the feed unit 2*a* encompassing the housing 17*a*.

The generation and evaluation of characteristic pulses or characteristic sequences of pulses in accordance with the invention is thus carried out in this embodiment in the same manner as in the embodiments above having a feed unit 2 which is movable along a storage area 10, so that it is made reference to the previous specifications.

Likewise, the feed device 1*a* is of modular design and configuration since it may be mounted as a pre-assembled unit to a shelf system via a fastening element 13*a*. The fastening element 13*a* here is formed as an angular sheet bent several times through 90 degrees via which the feed device 1*a* may be hooked in a holding bar H of the shelf system.

A connection of the electronics accommodated in the housing 17*a* to the downstream evaluation unit $A_1$, $A_2$ or to a control unit C, C* coupled thereto can also be realized by wire or wirelessly as it is the case in the embodiments of FIGS. 10A-10B and 11.

In addition to the embodiments shown, it would be also possible to provide for a feed device in which objects G are arranged and positioned on a storage area 10, but in which the feed unit is movable along a housing 17*a* mounted above or besides the storage area 10. Accordingly, the feed unit itself would not be arranged on the storage area 10, but still guided along the storage area 10 in order to apply a pushing force to the objects G. In such embodiments the feed unit could thus be guided as well along a (guide) surface of the housing which does not necessarily run parallel to the storage area 10.

The invention claimed is:

1. A feed device for the automatic shifting of objects, in particular goods or goods packages, wherein the feed device comprises a storage area or a holding element and a driven feed unit by means of which an object arranged on the storage area or at the holding element of the feed device can be shifted when the feed unit engages at the object, and wherein the feed device includes at least one electronic component which electronically detects a movement of the feed unit and which has different contact means at which in each case a pulse is generated which is characteristic for the respective contact means when the feed unit has covered a predefined distance, wherein the electronic component is configured such that the covering of a distance by the feed unit during movement of the feed unit is directly detected as an electric pulse and that the covering of respectively predefined distances of the feed unit generates a pulse sequence characteristic for the distances covered, wherein the contact means are respectively connected to one of several electric resistors being different from each other and/or are respectively associated to one of several electric circuits.

2. The feed device according to claim 1, wherein the electronic component is configured to detect the covering of a respective predefined distance by the feed unit during movement of the feed unit.

3. The feed device according to claim 1, wherein the feed device is configured and provided to shift a plurality of objects arranged one behind the other on the storage area or at the holding element when the feed unit engages at least one object.

4. The feed device according to claim 1, wherein a pulse is respectively generated when the feed unit has covered a predefined distance.

5. The feed device according to claim 4, wherein the electronic component includes contact means which are arranged at intervals of predefined distances and past which the feed unit is guided such that after the covering of the distance by the feed unit a pulse is generated on a contact means.

6. The feed device according to claim 5, wherein the contact means are arranged on the electronic component in the form of a raster.

7. The feed device according to claim 6, wherein several contact means are arranged along the electronic component one behind the other, which contact means are respectively associated to one of several electric circuits.

8. The feed device according to claim 4, wherein the contact element in operative contact with the electronic component respectively defines a total electric resistance, which for generating a characteristic pulse and/or a characteristic pulse sequence varies in dependence of a contact means of the electronic component, via which the contact element is in operative contact with the electronic component.

9. The feed device according to claim 4, wherein the contact element in operative contact with the electronic component respectively closes an electric circuit which is defined for the generation of a characteristic pulse and/or of a characteristic pulse sequence by the contact means.

10. The feed device according to claim 1, wherein the characteristic pulse sequence includes pulses with different amplitudes.

11. The feed device according to claim 1, wherein via the characteristic pulse sequence a direction of movement of the feed unit along the storage area or along the holding element can be detected.

12. The feed device according to claim 1, wherein the electronic component for detecting the movement of the feed unit is arranged on the bottom surface of the feed device opposite the storage area.

13. The feed device according to claim 1, wherein the feed device is configured such that the electronic component is held by at least two guide rails, by means of which the electronic component can be introduced into or along the feed device relative to the storage area or relative to the holding element during assembly of the feed device.

14. The feed device according to claim 1, wherein on the feed unit a contact element is arranged, which after covering the distance is in operative contact with the electronic component and causes the generation of an electric pulse.

15. The feed device according to claim 14, wherein the contact element can be plugged onto a section of the feed unit provided for this purpose or that the contact element is designed so that it may be wound and is mounted such that it is wound or unwound during a movement of the feed unit.

16. The feed device according to claim 14, wherein the electronic component is configured such that the contact element in operative contact with the electronic component respectively generates a pulse characteristic for the distance covered and/or a pulse sequence characteristic of a plurality of covered, predefined distances.

17. The feed device according to claim 1, wherein the contact element is configured such that it contacts, with a contact region, conductors of the electronic component during the movement of the feed unit, which conductors are arranged at a spacing of one distance one behind the other.

18. The feed device according to claim 1, wherein the feed device furthermore comprises an evaluation unit or is connected with an evaluation unit which evaluates the pulses generated and which is provided to evaluate a given number of detected pulses as a length of an object present on the storage area or at the holding element and/or as a number of objects removed from the storage area or from the holding element and/or to determine the frequency with which the objects are removed from the storage area or the holding element, to evaluate the same and/or to forward the same to a calculating unit.

19. A method for detecting a movement of a feed unit in a feed device, in particular a feed device according to claim 1, which is configured and provided for the automatic shifting of objects by means of the feed unit, the objects being arranged on a storage area of the feed device or at a holding element of the feed device, wherein for detecting the movement of the feed unit, at least one characteristic pulse is evaluated, which is respectively generated by the feed unit interacting with one of several different contact means of an electronic component after the feed unit has covered a predefined distance, wherein the contact means are respectively connected to one of several electric resistors being different from each other and/or are respectively associated to one of several electric circuits.

* * * * *